US011111066B2

(12) United States Patent
Futase

(10) Patent No.: US 11,111,066 B2
(45) Date of Patent: Sep. 7, 2021

(54) COMPOSITE PACK FOR FILLING LIQUID MATERIAL

(71) Applicant: YUSHIN CO., LTD., Niigata (JP)

(72) Inventor: Katsunori Futase, Niigata (JP)

(73) Assignee: YUSHIN CO., LTD., Niigata (JP)

( * ) Notice: Subject to any disclaimer, the term of this patent is extended or adjusted under 35 U.S.C. 154(b) by 0 days.

(21) Appl. No.: 16/609,841

(22) PCT Filed: Oct. 18, 2018

(86) PCT No.: PCT/JP2018/038869
§ 371 (c)(1),
(2) Date: Oct. 31, 2019

(87) PCT Pub. No.: WO2019/078304
PCT Pub. Date: Apr. 25, 2019

(65) Prior Publication Data

US 2020/0071048 A1 Mar. 5, 2020

(30) Foreign Application Priority Data

Oct. 20, 2017 (JP) ..... JP2017-203524
Dec. 8, 2017 (JP) ..... JP2017-236098
(Continued)

(51) Int. Cl.
*B65D 77/06* (2006.01)
*B65D 5/74* (2006.01)

(52) U.S. Cl.
CPC ..... *B65D 77/064* (2013.01); *B65D 5/742* (2013.01)

(58) Field of Classification Search
CPC ..... B65D 77/064; B65D 5/742; B65D 5/067; B65D 5/40
(Continued)

(56) References Cited

U.S. PATENT DOCUMENTS 2,377,533 A * 6/1945 Waters ..... B65D 5/067 229/117
2,987,234 A 6/1961 Kieckhefer
(Continued)

FOREIGN PATENT DOCUMENTS

GB 965650 8/1964
JP 2004-224358 8/2004
(Continued)

OTHER PUBLICATIONS

Official Communication issued in International Patent Application No. PCT/JP2018/038869, dated Nov. 20, 2018, along with English translation.

(Continued)

*Primary Examiner* — Christopher R Demeree
(74) *Attorney, Agent, or Firm* — Greenblum & Bernstein, P.L.C.

(57) ABSTRACT

A composite pack for filling liquid material having an interior member as a non-self-standing type liquid material filling package member of filling a liquid material and an exterior member capable of stably holding the interior member, includes a bag-shaped interior member formed by the liquid material into a soft package bag and an exterior member for housing the interior member and including a cylindrical body, a bottom wall disposed at a lower end of the cylindrical body and an opening portion formed in an upper end of the cylindrical body. The interior member includes a sheet-like nozzle for pouring the liquid material protruded in an upper end portion or a side end upper portion of the package bag, and the exterior member includes at the opening portion a sealing structure unit having a top face wall closing the opening portion and plural vertical rubs standing from the top face wall.

13 Claims, 22 Drawing Sheets

(30) Foreign Application Priority Data

| | | |
|---|---|---|
| Dec. 19, 2017 | (JP) | JP2017-243102 |
| Feb. 2, 2018 | (JP) | JP2018-017329 |
| Mar. 13, 2018 | (JP) | JP2018-045484 |
| May 25, 2018 | (JP) | JP2018-100365 |

(58) Field of Classification Search
USPC ... 229/117.3, 116, 155, 248, 125.04, 125.17; D9/569; 222/183; 220/495.06
See application file for complete search history.

(56) References Cited

U.S. PATENT DOCUMENTS

| | | | | |
|---|---|---|---|---|
| 3,190,531 A | | 6/1965 | Holmstrom | |
| 3,318,505 A | | 5/1967 | Garrison et al. | |
| 3,484,011 A | * | 12/1969 | Soper | B65D 23/02 215/12.1 |
| 3,567,073 A | | 3/1971 | Friedenthal | |
| 6,016,953 A | * | 1/2000 | Stacy-Ryan | B65D 5/06 229/113 |
| 2015/0041527 A1 | * | 2/2015 | Asai | B65D 5/40 229/117.31 |
| 2017/0240334 A1 | | 8/2017 | Myerscough | |

FOREIGN PATENT DOCUMENTS

| | | |
|---|---|---|
| JP | 2005-88896 | 4/2005 |
| JP | 2008-105693 | 5/2008 |
| JP | 2010-241447 | 10/2010 |
| JP | 2010-260614 | 11/2010 |
| JP | 2017-19558 | 1/2017 |
| JP | 2017-186021 | 10/2017 |
| WO | 2013/054411 | 4/2013 |

OTHER PUBLICATIONS

International Preliminary Report on Patentability for International Patent Application No. PCT/JP2018/038869 dated Apr. 30, 2020, along with English Translation.
Extended European Search Report issued in European Patent Application No. 18867478.2, dated Jun. 1, 2021.

* cited by examiner

FIG. 22 (a)
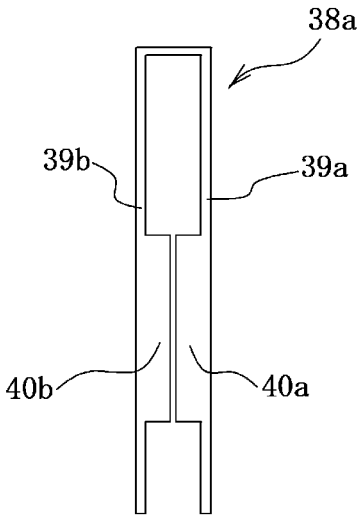
FIG. 22 (b)
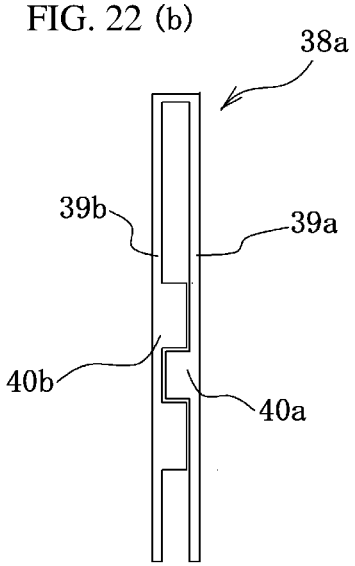
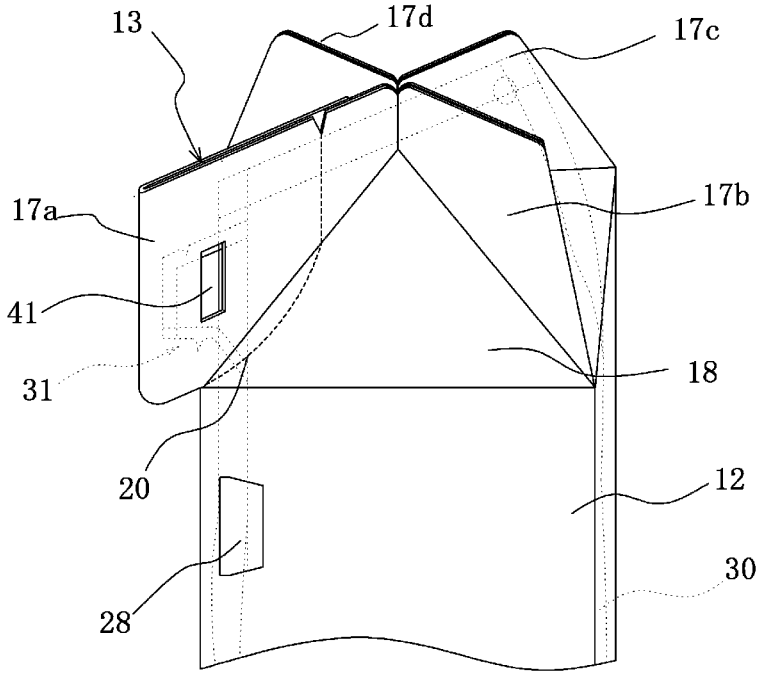
FIG. 22 (c)

COMPOSITE PACK FOR FILLING LIQUID MATERIAL

TECHNICAL FIELD

This invention relates to a composite pack for filling a liquid material, which is comprised of an interior member formed by filling and packing a liquid or viscous material into a package bag made of a plastic film or the like and an exterior member made of a paper or the like and housing and holding the interior member therein, and particularly proposes a composite pack for filling a liquid material capable of stably holding a non-self-supportable interior member for filling a liquid material such as drinks, medicines, chemicals or the like (assisting self-support of the interior member) and attaining an increase of a volumetric efficiency for the liquid material and an effective utilization of a display space in the displaying or the like.

RELATED ART

As an interior member formed by filling a liquid material into a plastic package bag or a liquid material filling package member are included ones proposed by the inventors and disclosed in Patent Documents 1 and 2. The package bag used in the liquid material filling package member is made from a soft laminate plastic film. Since the liquid material filling package member itself has not a self-supportability or a definite shape-ability, it is housed into an exterior member made of a self-supporting package bag or vessel or an exterior vessel in the transportation, storage, use or the like thereof.

Further, vessels of Patent Documents 3 and 4 are known as a liquid material filling paper vessel different from the aforementioned composite pack and using a gable top paper pack (milk carton or the like) for housing a milk or the like.

PRIOR ART DOCUMENTS

Patent Documents

Patent Document 1: JP-A-2010-260614
Patent Document 2: WO 2013/054411
Patent Document 3: JP-A-2017-186021
Patent Document 4: JP-A-2017-19558

SUMMARY OF THE INVENTION

Task to be Solved by the Invention

All of the self-supporting exterior vessels (package bags or vessels) used in the above prior arts are constructed so that a lower portion is cylindrical of polygon or the like as a planar view and a body portion is cylindrical of circular as a planar view and a top portion is plate-like in correspondence to a stereoscopic form in the standing posture of the liquid material filling package member to be housed. In the conventional exterior vessel, therefore, the volume of housing the liquid material in the top portion becomes small, so that there is a problem that the volume efficiency of the liquid material (volume of liquid material/height of exterior vessel) is low as compared to a paper carton or a plastic bottle.

Furthermore, the gable top paper pack as disclosed in Patent Documents 3 and 4 is recently required to be sealed completely by increasing a sealing strength of an overlapped portion in a top end in order to prevent not only liquid leakage at a distribution level but also incorporation of foreign matter or the like. Therefore, there are problems that children or old men being weak in the power cannot open the pack by its hand force and also if it is intended to open the pack forcibly, an unintended portion is broken or a pouring port is deformed.

Since the top portion of the gable top paper pack is gable-like, these packs cannot be built up by overlapping plural packs. As a result, there are problems that a wasted space is generated in the boxing for transportation to decrease the transportation efficiency and the display member is decreased in the displaying at a supermarket or a shop and hence restocking of goods should be conducted as needed.

It is, therefore, an object of the invention to provide a composite pack for filling a liquid material, which is comprised of an interior member as a non-self-supporting liquid material filling package member for filling liquid material and an exterior member capable of stably holding the interior member and is capable of attaining not only an increase of a volume efficiency for the liquid material but also space saving in the display or the like.

Solution for Task

The inventor has developed a liquid material filling composite pack having the following summary and constructions as a vessel capable of overcoming the aforementioned issues inherent to the prior arts.

That is, the invention is a composite pack for filling a liquid material, which is comprised of a bag-shaped interior member formed by filling a liquid material into a soft package bag and an exterior member having a cylindrical body provided on its lower end with a bottom wall and on its upper end with an opening portion for housing the interior member, characterized in that the interior member is provided with a sheet-like pouring nozzle for liquid material protruding to an upper end portion or a side end upper portion of the package bag, and the exterior member has a sealing structure unit comprising a top face wall for closing the opening portion and plural vertical ribs standing up from the top face wall.

The composite pack for filling a liquid material according to the invention has the preferable embodiments as mentioned below:

(1) the sealing structure unit is provided with at least three vertical ribs standing up from the flat or mountain-type top face wall and these vertical ribs are arranged radially from the approximately central position of the cylindrical body at a planar view of the cylindrical body;

(2) one of the vertical ribs is a vertical cover rib for clamping and covering the sheet-like pouring nozzle for liquid material, and the vertical cover rib has a given cut-off line capable of exposing the liquid material pouring sheet-like nozzle;

(3) the vertical rib is formed by overlapping a pair of standing walls formed by cutting and raising a part of the top face wall;

(4) the vertical rib is formed by connecting one standing wall to the other standing wall through a connecting piece;

(5) the connecting piece is provided with a notch portion as a starting point for breaking the connecting piece by applying external force to each standing wall constituting thee vertical rib so as to separate from each other;

(6) faces of the top face wall located at both sides of the vertical cover rib have gradient larger than that of the other faces of the top face wall;

(7) a lower end of a standing base end side of the vertical cover rib standing up from the top face wall is positioned to a level lower than a lower end of a standing base end side of the other vertical rib standing up from the top face wall;

(8) the interior member has a form that a protruding end of the sheet-like pouring nozzle for the liquid material is located on the inside of a side wall of the cylindrical body of the exterior member;

(9) the package bag is made from a single plastic film or a laminate film formed by laminating one or more plastic films or plural plastic films inclusive of a metallic foil, and the exterior member is made from a paper, a plastic film or a composite of plastic film and paper;

(10) at least an upper end portion backward a top of the interior member is joined and fixed to the exterior member;

(11) the cylindrical body of the exterior member has an approximately equal opening area over a full length from the bottom wall to the opening portion at its upper end;

(12) the sealing structure unit of the exterior member is provided with a detachable cap for covering the sheet-like pouring nozzle for the liquid material during exposure; and

(13) the sheet-like pouring nozzle for the liquid material has a self-sealing function that the pouring of the liquid material in the package bag is performed by tilting of the package bag or pushing to the package bag without sucking external air, while an inner face of a pouring pathway in the sheet-like pouring nozzle for the liquid material is closed immediately with the interposing of a thin film of the liquid flowed from the package bag to block penetration of external air into the package bag in the stop of the pouring by returning the package bag to the stand posture or releasing the pushing to the package bag.

Effect of the Invention

According to the composite pack for filling liquid material of the invention, the opening portion located at the upper end of the cylindrical body of the exterior member is sealed by the sealing structure unit comprised of plural vertical ribs and top face wall (top face plate), so that the cylindrical body of the exterior member housing the interior member may be a box-type columnar body or a cylindrical body having an approximately equal opening area and hence a zone from the bottom portion to the upper portion of the cylindrical body can be contributed to the housing of the liquid material. According to the invention, therefore, the volume efficiency for the liquid material is increased to the same level as in the plastic bottle and the fitting performance is good in the display or the like of arranging plural packs and space saving can be attained.

According to the composite pack for filling liquid material of the invention, one of the plural vertical ribs constituting the sealing structure unit arranged in the opening portion at the upper end of the cylindrical body of the exterior member is the vertical cover rib for pinching and storing the sheet-like pouring nozzle for the liquid material (hereinafter referred to as "sheet-like nozzle") protruded from the upper end portion or side end upper portion of the interior member. Therefore, even when the sheet-like nozzle is made from a thin and soft plastic film, it is protected with the vertical cover rib, so that there is no fear of deforming or erroneously opening in the handling for transportation or the like, and the sheet-like nozzle can be exposed outward in use by cutting out only the vertical cover rib along the given separable line.

In the invention, each of the plural vertical ribs constituting the sealing structure unit is formed by overlapping the pair of the standing walls formed by cutting and raising a part of the top face wall (communicating to the top face wall), whereby the opening portion at the upper end of the cylindrical body of the exterior member can be sealed while suppressing the height of the exterior member.

According to the invention, the opening portion at the upper end of the cylindrical body can be opened simply by pulling the plural vertical ribs constituting the sealing structure unit in a direction of separating from each other with fingers, respectively, so that disposal can be performed by taking out the interior member from the exterior member and conducting separation by every material. Furthermore, according to the invention, the plural vertical ribs (preferably not less than 3 ribs) is arranged in the sealing structure unit, whereby the plurality of the composite packs for filling liquid material can be laminated through these vertical ribs and space saving can be attained in the transportation, display and so on.

According to the invention, the vertical ribs in the sealing structure unit are arranged radially from an approximately central position of the exterior member as a planar view of the exterior member, preferably extended in a cruciform direction. Therefore, these vertical ribs can be distorted independently and softly, so that even if the composite pack for filling liquid material is fallen down accidentally, the falling shock is absorbed by each of the vertical ribs and hence the joint portion of the vertical rib cannot be peeled off simply but also the composite pack for filling liquid material (exterior member) can be held at its original form.

In the invention, when the interior member is joined and fixed to the exterior member at least at an upper end portion backward a top thereof (opposite side to the protruding position of the nozzle), the sheet-like nozzle is tilted downward for pouring the liquid material from the composite pack for filling liquid material, whereby it is made possible to suppress the deformation of the sheet-like nozzle and conduct smooth pouring. Even if the sheet-like nozzle has a self-sealing function, penetration of external air can be prevented sufficiently without blocking adhesion of faces in the pouring pathway.

Moreover, the package bag used for constituting the interior member is preferable to be made from the single plastic film or a laminate film formed by laminating two or more plastic films or plural plastic films inclusive of a metallic foil. Especially, when using a chewy film, the occurrence of wrinkles in the interior member can be suppressed in the tilting of the composite pack for filling liquid material for pouring the liquid material and the slippage of the interior member can be suppressed.

In the invention, the gradient of the faces of the top face wall located at both sides sandwiching the vertical cover rib are made larger than the gradient of the other faces of the top face wall, whereby a space forming the vertical cover rib can be made large and the protruding end of the sheet-like nozzle housed in the side edge of the vertical cover rib and inside thereof can be positioned inward the side wall of the cylindrical body of the exterior member. Therefore, when the plural composite packs for filling liquid material are displayed and housed, space saving can be attained without knocking these composite packs for filling liquid material to each other, while breakage or the like can be reduced.

According to the invention, when the vertical cover rib is cut out, the sheet-like nozzle can be protruded from the adjoining top face wall over a full length of the nozzle from the base end portion thereof. Therefore, the sheet-like nozzle is not influenced by clamping of the remaining vertical cover rib or the like and the packed material can be poured from the tip of the sheet-like nozzle into a target direction while controlling the pouring amount to improve liquid-cut property.

Moreover, the above effect can be developed more effectively by elongating the standing base end side of the vertical cover rib downward and positioning to a level lower than the standing base end side of the other vertical rib.

In the invention, the exterior member is provided with the detachable cap capable of covering the sheet-like nozzle exposed from the sealing structure unit to outside, whereby contamination of the pouring port can be prevented even if the sheet-like nozzle is stored after the opening, which is hygienic. Also, when the cap is provided with a clamping structure for the sheet-like nozzle, even if the composite pack for filling liquid material is fallen down accidentally after the opening of the sheet-like nozzle, leakage of the liquid material can be prevented.

BRIEF DESCRIPTION OF THE DRAWINGS

FIGS. 22(*a*) and 22(*b*) are end views of the cap of FIG. 21 at a position B-B and FIG. 22(*c*) is a perspective view illustrating a state of forming a window hole in a vertical rib of an exterior member in the composite pack for filling liquid material according to the invention.

EMBODIMENTS FOR CARRYING OUT THE INVENTION

The composite pack for filling liquid material according to the invention is constructed with a bag-shaped interior member formed by filling a liquid material into a soft package bag made from a plastic film or the like and an exterior member made from a paper, aplastic or the like for housing and holding the interior member. The features of the invention will be described based on the illustrated embodiments below.

Figure 1:
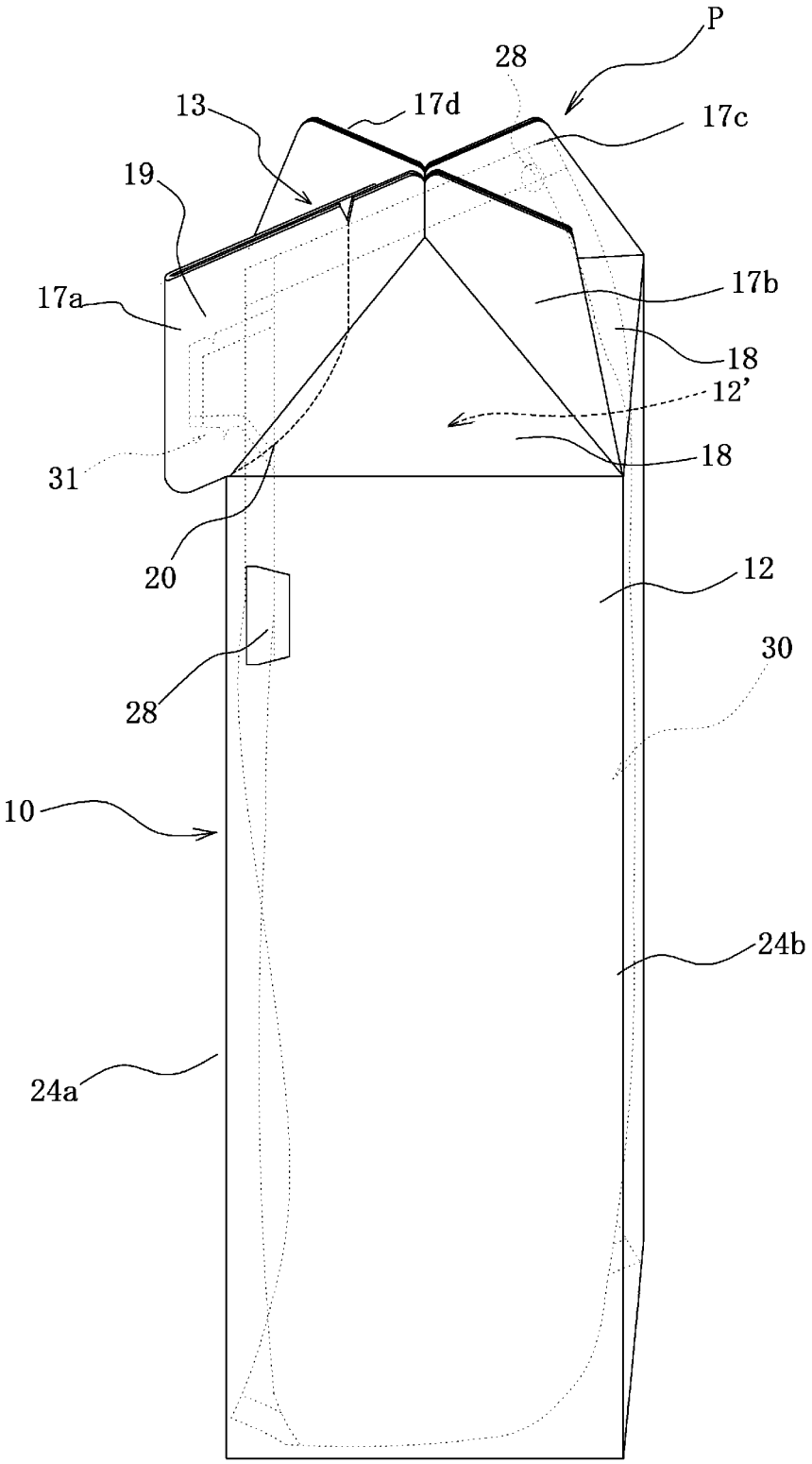
FIG. 1 is a perspective view of an embodiment of the composite pack for filling a liquid material according to the invention.
Figure 2:
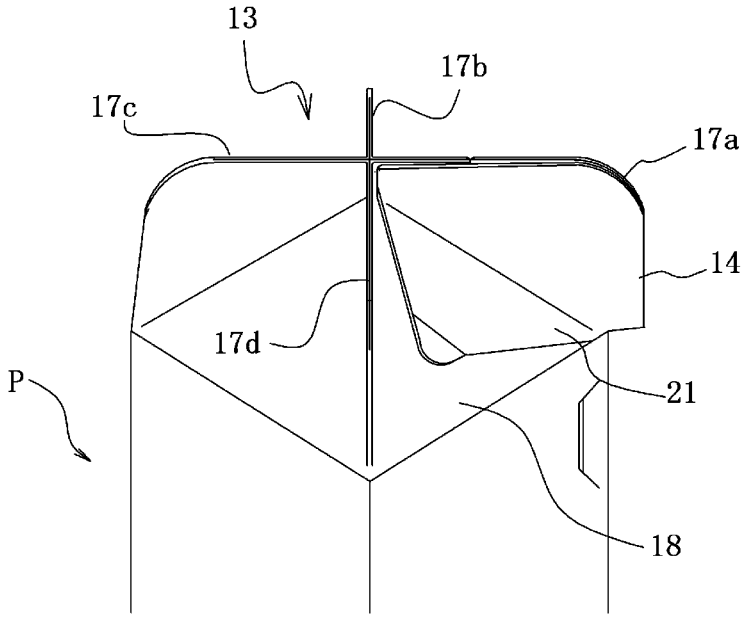
FIG. 2 is a perspective view illustrating an upper portion at a rear side of the composite pack for filling liquid material of FIG. 1.
Figure 3:
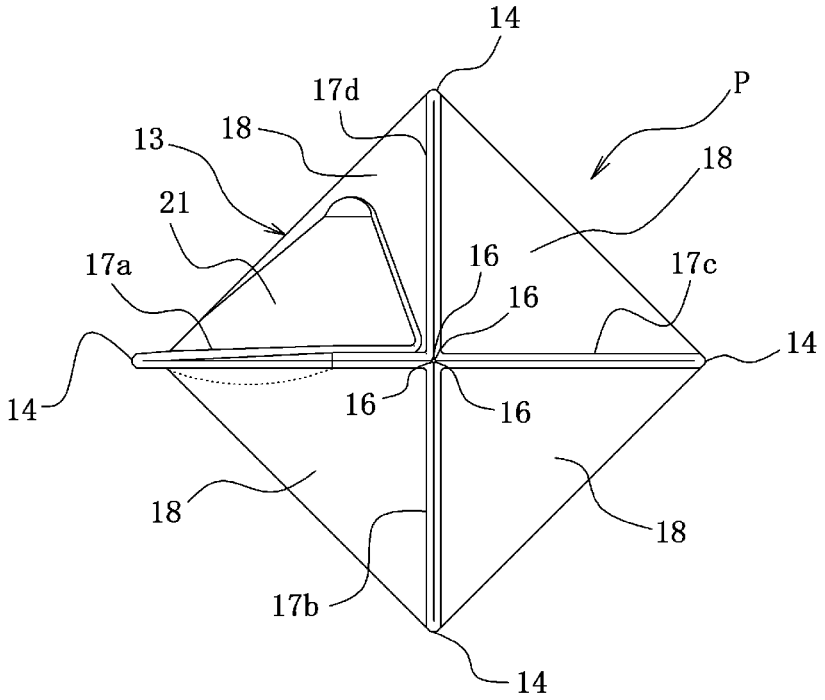
FIG. 3 is a plan view of the composite pack for filling liquid material shown in FIG. 1.
Figure 4:
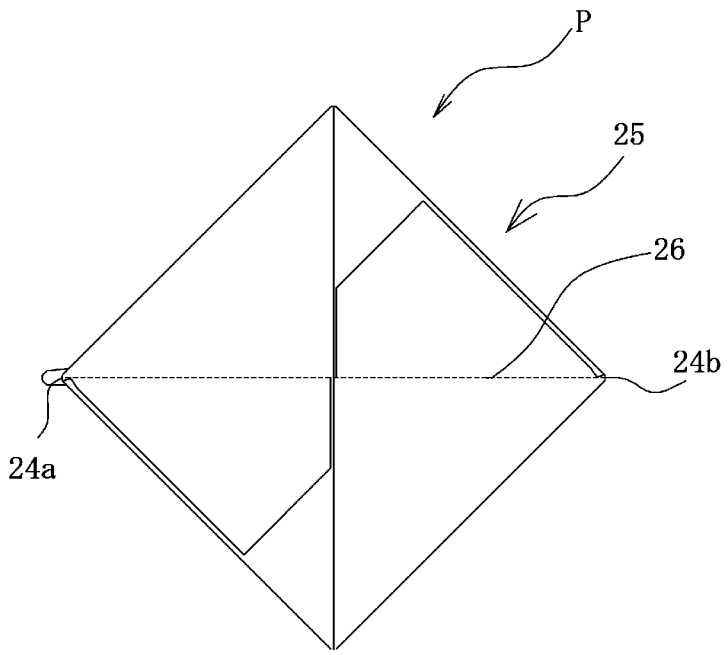
FIG. 4 is a bottom view of the composite pack for filling liquid material shown in FIG. 1.

FIG. 1 is a perspective view illustrating an embodiment of a composite pack P for filling liquid material, and FIG. 2 is a perspective view illustrating an upper portion at a rear side of the composite pack P for filling liquid material, and FIG. 3 is a plan view of the composite pack P for filling liquid material, and FIG. 4 is a bottom view of the composite pack P for filling liquid material.

The composite pack P for filling liquid material is constructed with an interior member 30 shown by a dotted line in FIG. 1 and an exterior member 10 for housing and holding the interior member 30. The interior member 30 and the exterior member 10 are preferable to be fixed to each other by joining in at least one location. As a fixed portion 28 is preferable an upper end portion rearward a top of the interior member 30 (a side opposite to a protruding position of a sheet-like nozzle 31) as shown in FIG. 1. By the arrangement of the fixed portion 28 is made possible to perform smooth pouring without causing deformation of the sheet-like nozzle 31 when the composite pack P for filling liquid material is tilted so as to direct the sheet-like nozzle 31 downward for pouring the liquid material, while penetration of ambient air can be prevented sufficiently without blocking adhesion of inner faces in a pouring pathway to each other even if the sheet-like nozzle 31 has a self-sealing function of preventing penetration of ambient air as mentioned later.

The fixed portion 28 may be disposed in a position just beneath the sheet-like nozzle 31 in the interior member 30 as shown in FIG. 1. In this case, it may be formed by cutting a part of the exterior member 10 and pushing inward and sticking an inner face of the cut portion to an outer face of the interior member 30 located at the inside thereof as shown in the figure.

The upper portion of the composite pack P for filling liquid material is sealed by a sealing structure unit 13 comprised of four vertical ribs 17*a*-17*d* made from a pair of standing walls arranged radially (cruciform) and a top face wall 18 as shown in a plan view of FIG. 3. On the contrary, the lower portion of the composite pack P for filling liquid material is provided with a bottom wall 25 (bottom plate) as shown in a bottom view of FIG. 4, and the bottom wall 25 is formed by engaging or sticking plural bottom walls (4 walls in FIG. 4) continuing from a lower end of a cylindrical body 12 to each other. Moreover, the composite pack P for filling liquid material is comprised of the interior member 30 formed by filling the liquid material into the package bag and the exterior member 10 and the liquid material is not directly filled into the exterior member 10, so that the bottom wall 25 of the exterior member 10 may be anything as far as self-standing property is applied and falling-off of the interior member 30 can be prevented.

At first, the exterior member 10 will be described below.

As shown in FIG. 1, the exterior member 10 is provided with a cylindrical body 12 and a sealing structure unit 13 for sealing an opening portion 12' located at the upper end of the cylindrical body 12 (12' is set as "upper end opened portion" hereinafter). Moreover, the sealing structure unit 13 is constructed with four vertical ribs 17*a*-17*d* composed of the pair of standing walls arranged radially and a mountain type top face wall 18 (top face plate) connecting the vertical ribs 17*a*-17*d* to the upper end opened portion 12'.

Figure 5:
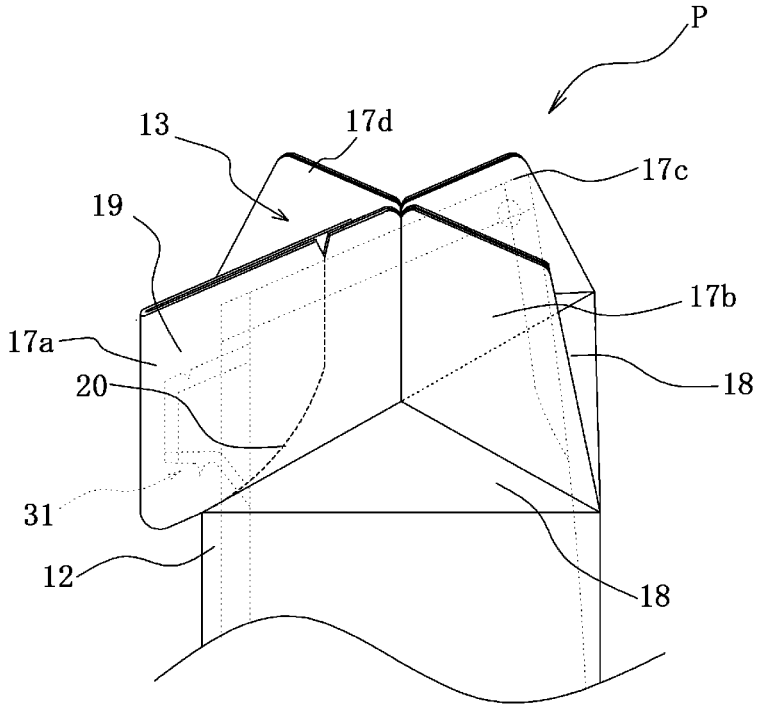
FIG. 5 is a perspective view illustrating another embodiment of a sealing structure unit in the composite pack for filling liquid material according to the invention.

In this embodiment, the cylindrical body 12 of the exterior member 10 is shown to be a quadrangular prism body as an example, but is not limited thereto in the invention. Also, the cylindrical body 12 may be a polygonal prism such as triangular prism, pentagonal prism or the like or a circular cylinder. The top face wall 18 may be a flat form approximately perpendicular to the vertical ribs 17*a*-17*d* as shown in FIG. 5. In the latter case, the height of the exterior member 10 can be suppressed.

Also, the material of the exterior member 10 is not particularly limited, but is preferable to be a material having a strength capable of applying the self-standing property as the composite pack P for filling liquid material. It may be a paper, a plastic film, a composite of paper and plastic film or the like. The composite of paper and plastic film is ones obtained by using a paper as a base and laminating at least one plastic film such as nylon, polyester, polyethylene or the like thereon. It is further preferable to laminate a metallic foil, a metal deposited layer, various barrier layers or the like, if necessary. Moreover, the exterior member 10 is preferable to be formed by folding the one sheet in view of increasing the production efficiency. In this embodiment, the exterior member 10 is described to be made from a paper as an example.

Figure 6:
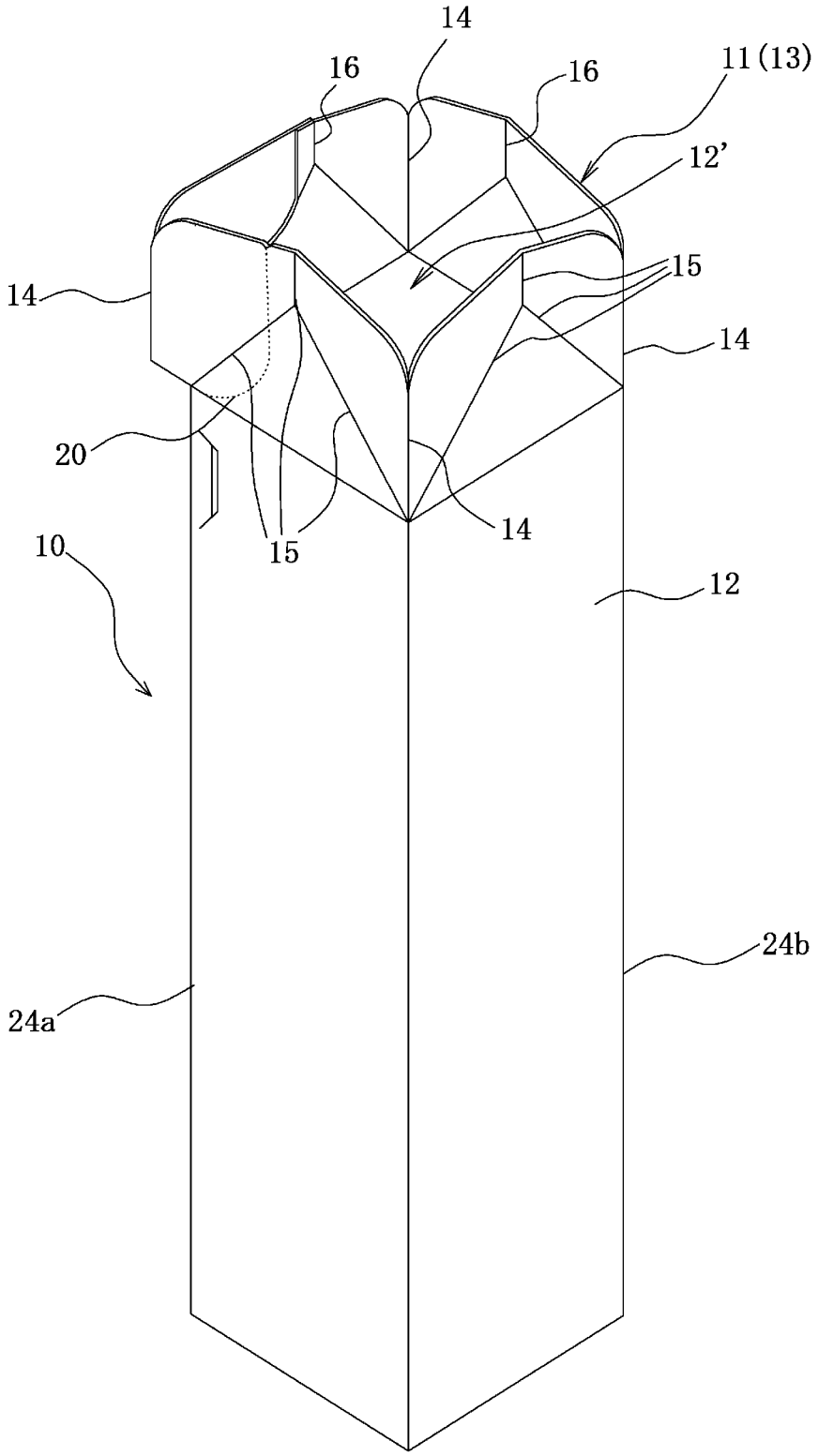
FIG. 6 is a perspective view of an exterior member constituting the composite pack for filling liquid material shown in FIG. 1 before the housing of an interior member.

FIG. 6 is a perspective view illustrating an embodiment of the exterior member 10 before the housing of the interior member 30.

Figure 7:
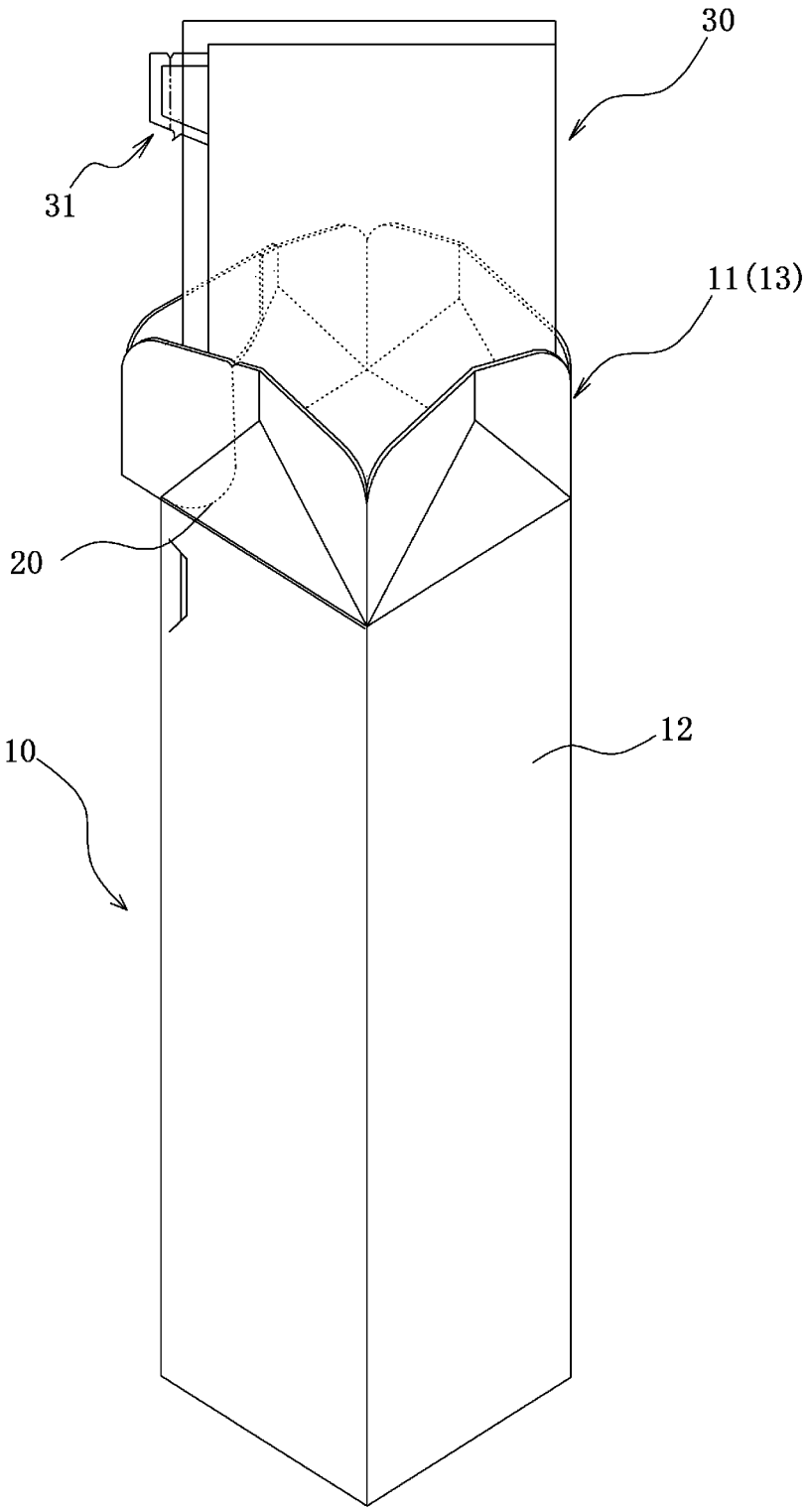
FIG. 7 is a perspective view illustrating a state of housing an interior member into the exterior member of FIG. 6.

A circular body 11 forming the sealing structure unit 13 for sealing the upper end opened portion 12' is provided on an upper end edge of the cylindrical body 12. As shown in FIG. 7, the interior member 30 filled with the liquid material is housed through the upper end opened portion 12' of the cylindrical body 12. In this case, it is preferable to overlap an upper end edge of the sealing structure unit 13 in the exterior member 10 with an upper end edge of the housed interior member 30 (for example, partly sticking them) in order to fix the interior member 30 to the exterior member 10 and arrange the sheet-like nozzle 31 of the interior member 30 to a given position.

The circular body 11 is comprised of a pair of standing walls by folding mountain-folded lines 14 extending from 4 corner portions of the cylindrical body 12 along valley-folded lines 15 formed between the mountain-folded lines 14 and butting four internal tip portions 16 in the valley-folded lines 15 to each other to thereby form the sealing structure unit 13 comprised of four radially positioned (cruciform) vertical ribs 17*a*-17*d* (mountain-folded portions) and the mountain-shaped top face wall 18 formed between the vertical ribs 17*a*-17*d* and the upper end opened portion 12'.

In this embodiment, four vertical ribs 17*a*-17*d* are disposed in the sealing structure unit 13. It is preferable to disposed three or more vertical ribs in the sealing structure unit 13. The number of the ribs is properly set in accordance with the purpose, applications and so on.

In the thus constructed composite pack P for filling liquid material, the liquid material can be filled at the same opening area over a full length from the bottom portion to the upper portion of the cylindrical body 12 of the exterior member 10, while the height of the composite pack P for filling liquid material can be decreased as far as possible by sealing the upper end opened portion 12' of the cylindrical body 12 with the sealing structure unit 13 disposed in the upper end opened portion 12'. In the composite pack P for filling liquid material according to the invention, therefore, it can be expected that the volume efficiency of the liquid material is 2 times or more of an exterior vessel shown in the prior art and can be increased to the same level in the usually distributed plastic bottles.

In the composite pack P for filling liquid material, four vertical ribs 17*a*-17*d* in the sealing structure unit 13 are formed by butting four internal tip portions 16 in the valley-folded lines 15 to each other as mentioned above, so that the upper end opened portion 12' can be opened easily by pulling two opposed vertical ribs, i.e. vertical rib 17*a* and vertical rib 17*c* or vertical rib 17*b* and vertical rib 17*d* in FIG. 1 in a direction of separating away from each other with fingers. After use, the interior member 30 is taken out from the exterior member 10, whereby both the materials can be sorted and disposed, respectively.

Moreover, the sheet-like nozzle 31 of the interior member 30 is housed between the pair of standing walls in one of the four vertical ribs 17*a*-17*d*, i.e. the vertical rib 17*a* in FIG. 1 as indicated by dotted lines, so that the vertical rib 17*a* acts as a cover 19 for the sheet-like nozzle 31. Thus, the sheet-like nozzle 31 is protected from both front and rear faces by the cover 19 before the start of use, and hence there is no fear of deforming or erroneously opening the sheet-like nozzle 31 in the handling for transportation or the like. If at least a part of the sheet-like nozzle 31 is detachably stuck or fused to an inner face of the cover 19, the deformation or the like of the sheet-like nozzle 31 can be more suppressed.

On the other hand, the remaining three vertical ribs 17*b*-17*d* act as sealing pieces by sticking or fusing the pairs of standing walls overlapped at least in their upper end portions for sealing the upper end opened portion 12' of the cylindrical body 12 in cooperation with the top face wall 18. In this case, it is preferable to fix the interior member 30 to the exterior member 10 by interposing the upper end portion of the interior member 30 between the pair of standing walls in the vertical ribs 17*b*-17*d*.

In this embodiment, each of the four vertical ribs 17*a*-17*d* is disposed on a straight line passing through four corners thereof in a plan view of the cylindrical body 12. It is preferable that the vertical rib 17*a* as the cover 19 for housing and holding the sheet-like nozzle 31 is positioned at least on a straight line passing through at least one corner portion of the cylindrical body 12.

As shown in FIG. 1, the cover 19 can be cut out along a predetermined cut-off line 20 of perforation or the like formed in the sealing structure unit 13. By cutting out the cover 19 can be exposed the sheet-like nozzle 31 from inside to outside.

Figure 8:
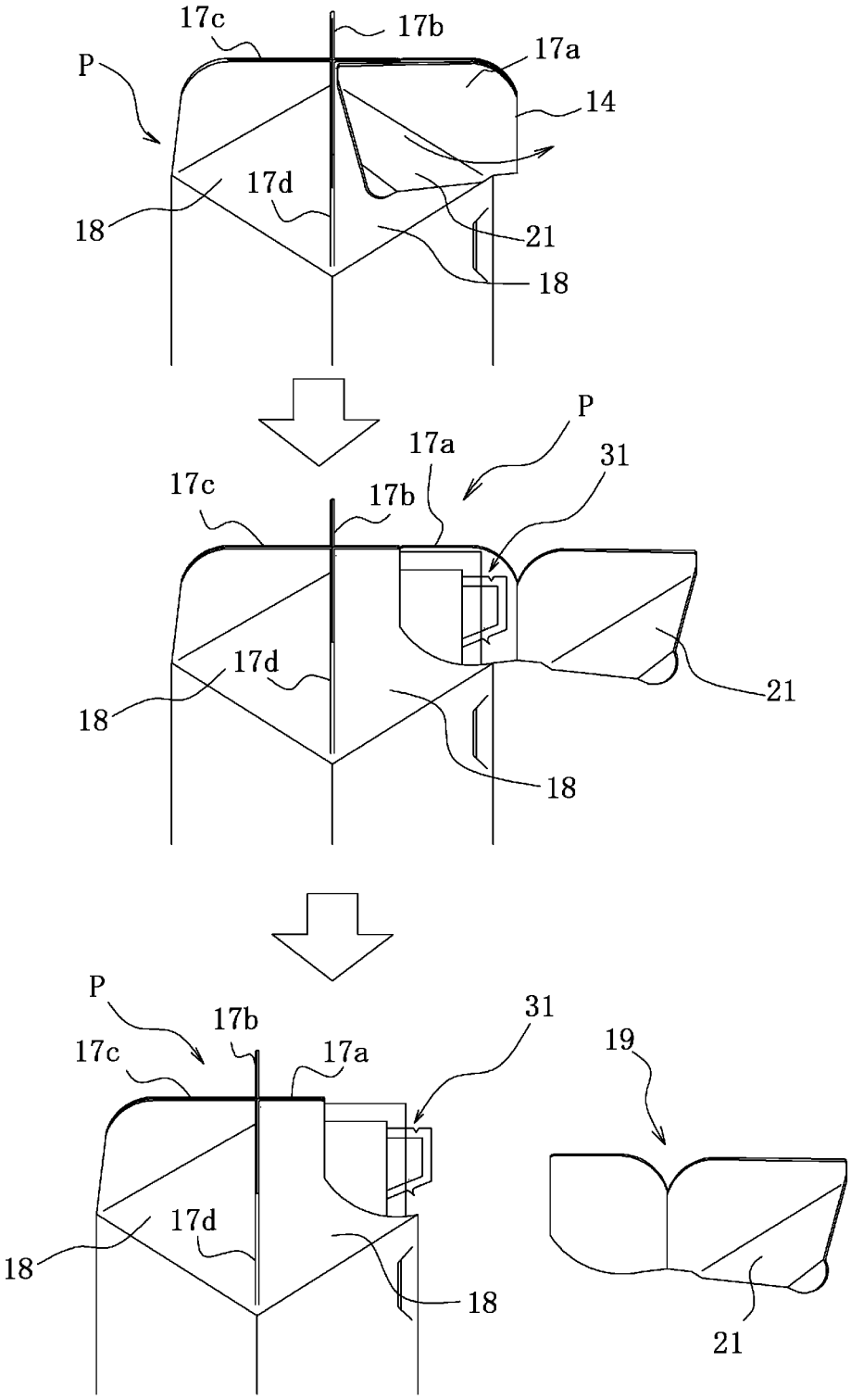
FIG. 8 is a schematic view showing a method of cutting out a cover disposed in the exterior member of the composite pack for filling liquid material shown in FIG. 1.
Figure 9:
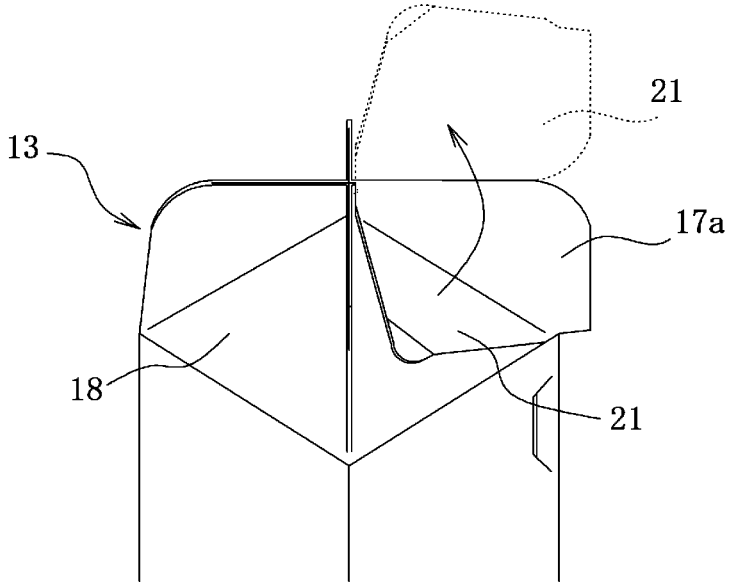
FIG. 9 is a schematic view illustrating another embodiment of the cover disposed in the exterior member of the composite pack for filling liquid material.

Moreover, one of the pair of standing walls constituting the vertical rib 17*a* is a flap 21 as shown in FIGS. 2 and 3. The flap 21 can be opened by using the mountain-folded line 14 as shown in FIG. 8 or an upper end edge of the vertical rib 17*a* as shown in FIG. 9 as a starting point.

The method of cutting out the cover 19 will be described by using FIG. 8 as an example. At first, the flap 21 is opened with fingers by using the mountain-folded line 14 as a starting point and then the vertical rib 17*a* (cover portion 19) is cut out along the predetermined cut-off line 20 formed in the other wall to expose the sheet-like nozzle 31 outward. Moreover, it is preferable that at least a part of the flap 21 is stuck or fused to the other standing wall of the vertical rib 17*a* to suppress exposure of the sheet-like nozzle 31 from inside to outside until the start of use.

Also, it is preferable that a predetermined crushing line 24*a* is formed in the cylindrical body 12 of the exterior member 10 located just beneath the sheet-like nozzle 31 (corner portion of quadrangular prism in FIG. 1) and a predetermined another crushing line 24*b* is formed in the cylindrical body 12 located opposite thereto (another corner portion of the quadrangular prism in FIG. 1). Further, it is preferable that the bottom wall 25 is provided with a predetermined bending line 26 of perforation or the like communicated with the predetermined crushing lines 24*a* and 24*b* for bending the bottom wall 25 inward the cylindrical body 20 as shown in FIG. 4.

Thus, the exterior member 10 can be crushed along the predetermined crushing lines 24*a*, 24*b* and the predetermined bending line 26 until the cylindrical body 12 becomes flat, so that the pouring amount of the liquid material can be adjusted by the pushing amount with fingers, while the liquid material can be squeezed out up to the end even if the residual amount of the liquid material becomes small.

In FIG. 1, the cylindrical body 12 of the exterior member 10 is a quadrangular prism, so that the predetermined crushing line 24*b* is located in a corner portion of the cylindrical body 12. However, the predetermined crushing line 24*b* is properly formed in the wall portion of the cylindrical body 12 in accordance with the form of the cylindrical body 12.

Figure 10:
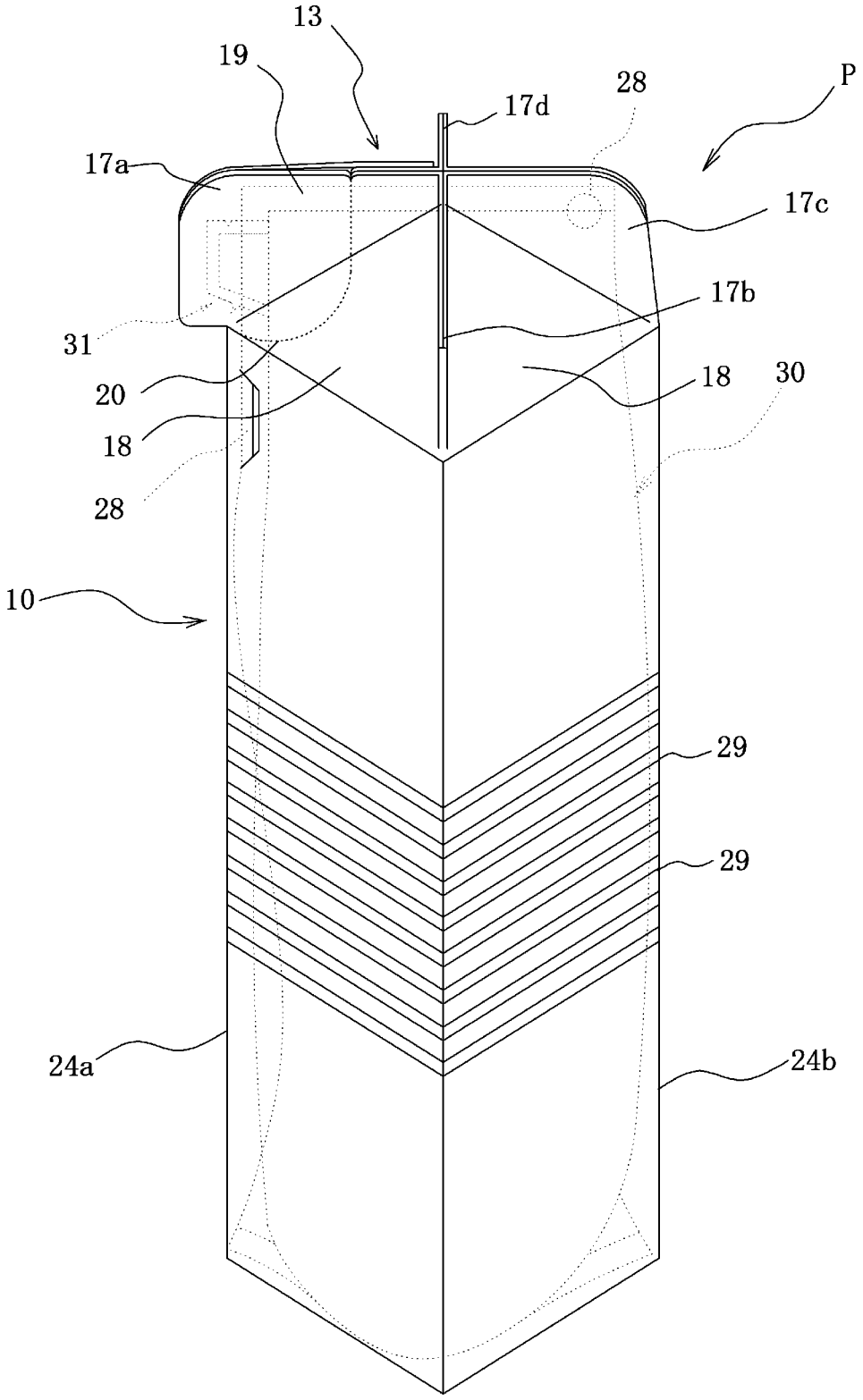
FIG. 10 is a perspective view illustrating another embodiment of the composite pack for filling liquid material according to the invention.

FIG. 10 is a perspective view illustrating another embodiment of the composite pack P for filling liquid material according to the invention. In this composite pack P for filling liquid material, plural concave strips 29 each extending in a horizontal direction are formed in the wall face of the cylindrical body 12 of the exterior member 10 at a position gripping with fingers, for example, within a range of about 5 cm upward and downward from a central position in the height direction of the cylindrical body 12. The slipping off of the composite pack can be suppressed by these concave strips 29 when it is gripped with fingers. Moreover, the concave strips 29 can be formed by pressing a material constituting the exterior member 10 such as paper or the like in a given form.

Figure 11:
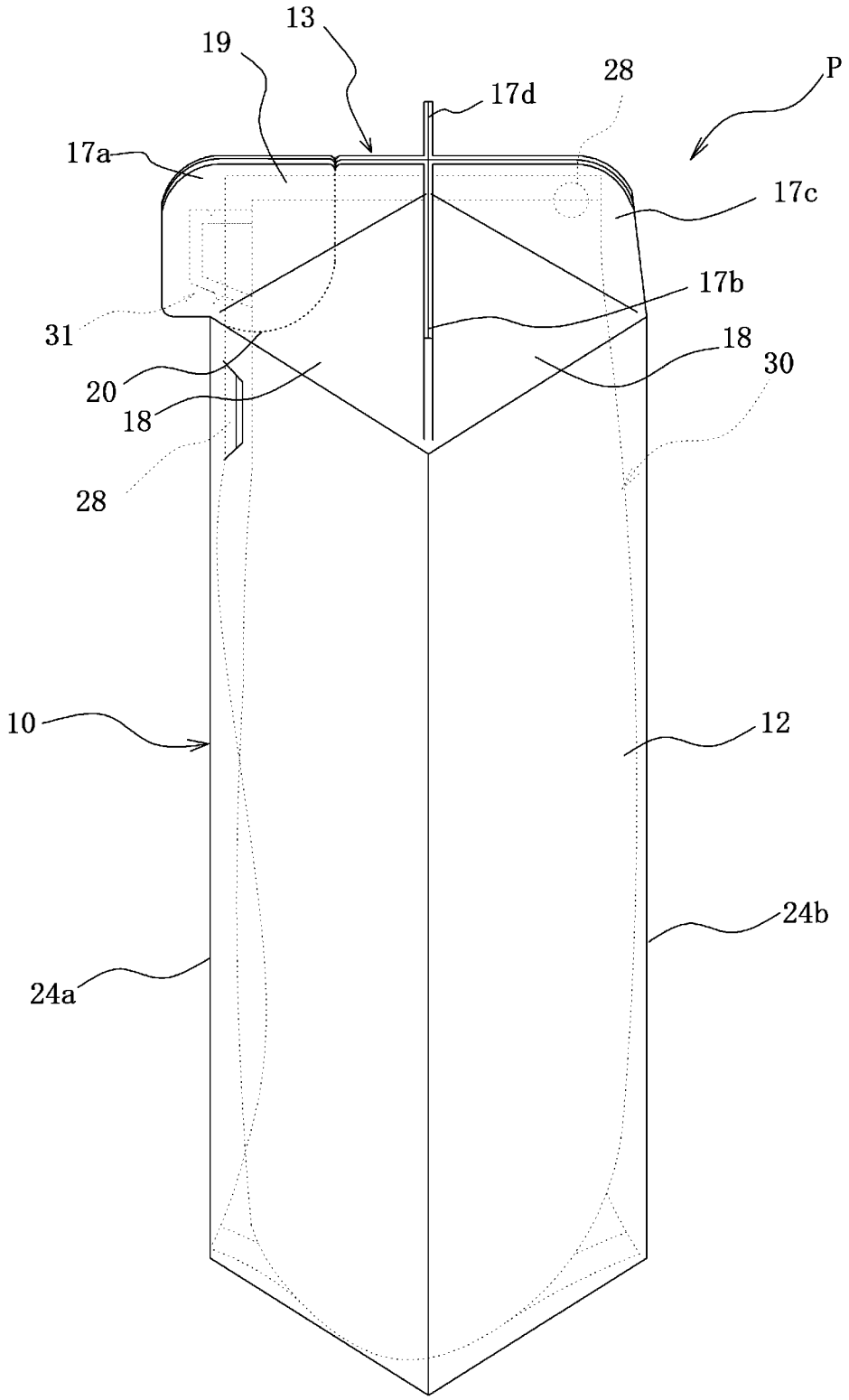
FIG. 11 is a perspective view illustrating the other embodiment of the composite pack for filling liquid material according to the invention.

FIG. 11 is a perspective view illustrating the other embodiment of the composite pack P for filling liquid material according to the invention, which is different from the composite pack P for filling liquid material of FIG. 1 in the structure of the pair of standing walls constituting the vertical rib 17*a* of the exterior member 10. In this composite pack P for filling liquid material, the standing walls have the same form and the predetermined cut-off line 20 is formed in each of the two standing walls in the same form. Therefore, the vertical rib 17*a* composed of the pair of standing walls (cover 19) can be cut out at once by tearing or folding along the predetermined cut-off lines 20.

Figure 12:
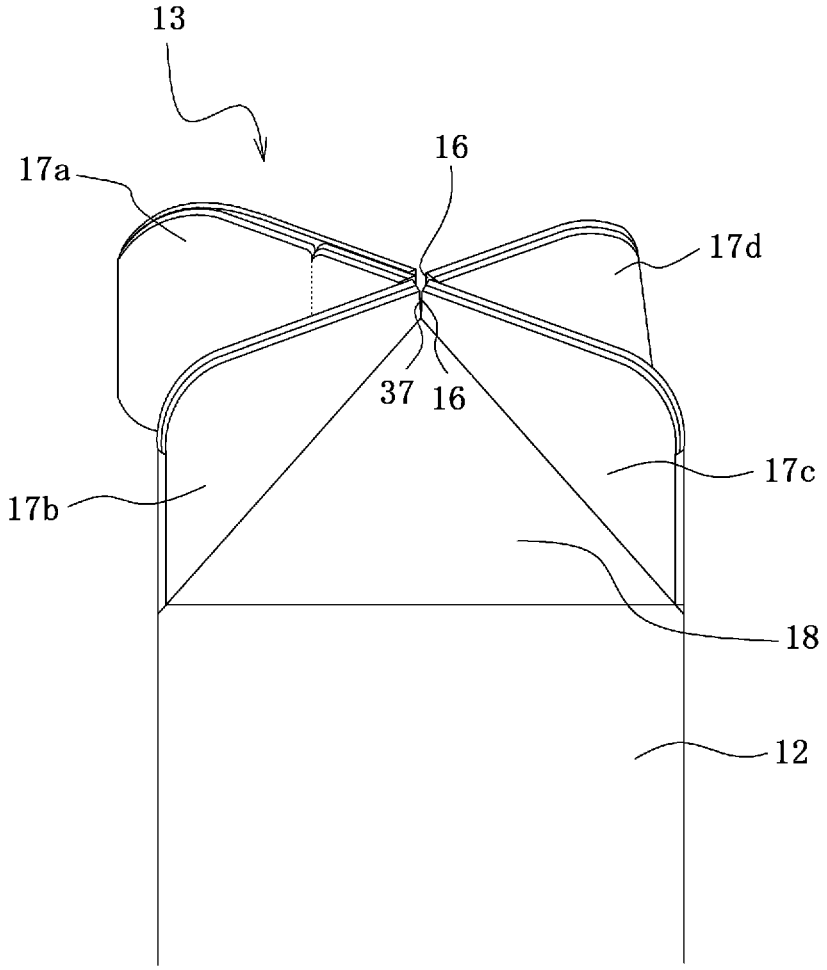
FIG. 12 is a perspective view illustrating the other embodiment of the sealing structure unit in the composite pack for filling liquid material according to the invention.

FIG. 12 is a perspective view illustrating another embodiment of the sealing structure unit 13 in the composite pack P for filling liquid material according to the invention. As shown in FIG. 12, the vertical ribs 17*a*-17*d* are segmented through an incision 37 formed in a central portion thereof, respectively. Therefore, the four vertical ribs 17*a*-17*d* are held at an independent state, respectively, so that even if the composite pack P for filling liquid material is dropped in error during the handling or the like, the dropping impact is absorbed by softly distorting each of the vertical ribs 17*a*-17*d* and the joint of the vertical ribs 17*a*-17*d* (between mutual walls) is prevented from peeling, deforming or the like and hence the composite pack P for filling liquid material (exterior member 10) can be held at its original form. Also, when the opposed two vertical ribs (vertical rib 17*a* and vertical rib 17*c* or vertical rib 17*b* and vertical rib 17*d*) are pulled in a direction of separating away from each other with fingers, the sealing structure unit 13 can be opened easily by using the incision 37 as a starting point. Furthermore, the four vertical ribs 17*a*-17*d* are at an independent state, respectively, so that inner faces of the two standing walls are easily overlapped to each other, and hence the sealing structure unit 13 can be shaped easily.

Figure 13:
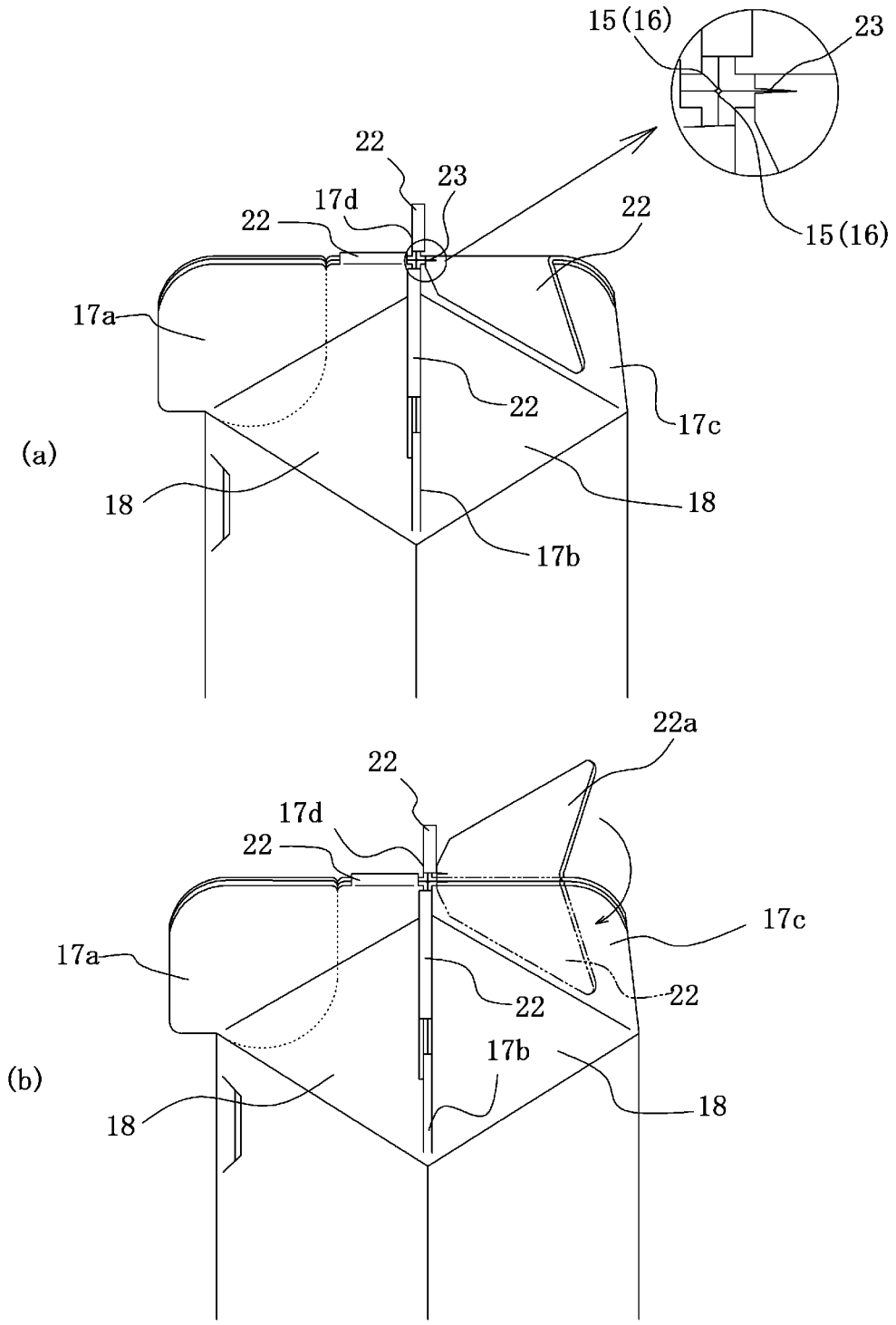
FIG. 13 is a perspective view illustrating a structure of a connecting piece.

As shown in FIG. 13(*a*), it is preferable that at least one connecting piece 22 connecting one standing wall to the other standing wall is disposed in each upper end portion of the vertical ribs 17*a*-17*d*. The joining strength between the pair of standing walls in each of the vertical ribs 17*a*-17*d* is increased by the connecting piece 22, so that even if the composite pack P for filling liquid material is dropped in error during the handling or the like, the joint of the vertical ribs 17*a*-17*d* (between mutual standing walls in the pair) is prevented from peeling, deforming or the like and hence the composite pack P for filling liquid material (exterior member 10) can be held at its original form.

The connecting piece 22 is made of a member different from the exterior member 10. As shown in FIG. 13, the connecting piece 22 for connecting the two standing walls can be formed by arranging a protrusion piece 22*a* continued from one wall in the pair of standing wall constituting the vertical rib 17*c* and folding or sticking the protrusion piece 22*a* to the wall face of the other wall.

Moreover, since the connecting piece 22 is strongly stuck to the wall faces of the vertical ribs 17*a* and 17*b*, when the interior member 30 is taken out from the exterior member 10, for example, in the disposal or the like of the composite pack P for filling liquid material, the connecting piece 22 cannot be broken by a force with fingers and hence there is a fear that the sealing structure unit 13 cannot be opened easily. As shown enlargedly in FIG. 13(*a*), therefore, it is preferable to dispose a notch portion 23 in the connecting piece 22 between double standing walls constituting the vertical rib 17*c*, preferably in an end portion side an internal tip portion 16 of the valley-folded line 15. In this case, when the opposed vertical ribs (vertical rib 17*a* and vertical rib 17*c* or vertical rib 17*b* and vertical rib 17*d*) are pulled with fingers in a direction of separating away from each other, the connecting piece 22 can be broken easily from the notch portion 23 as a starting point.

Figure 14:
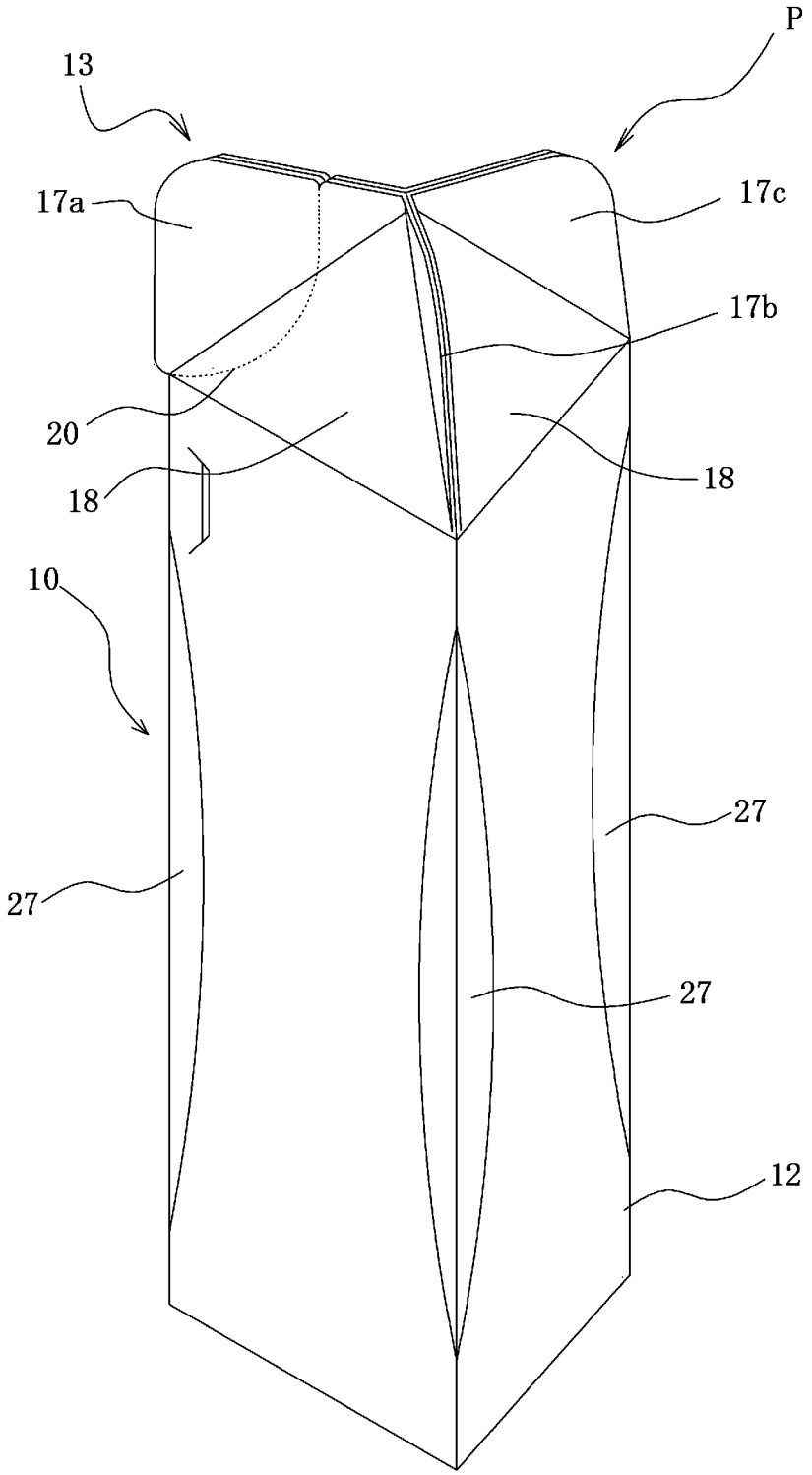
FIG. 14 is a perspective view illustrating a further embodiment of the composite pack for filling liquid material according to the invention.

In FIG. 14 is shown another embodiment of the composite pack P for filling liquid material according to the invention. In this composite pack P for filling liquid material, three vertical ribs 17*a*-17*c* are disposed as the sealing structure unit 13 of the exterior member 10. As shown in this figure, an easily-deforming portion 27 capable of depressing and deforming inward is disposed in a corner portion of the cylindrical body 12 of the exterior member 10 or a wall portion of the cylindrical body positioning a finger (not shown) when the cylindrical body 12 is grasped with fingers. When the exterior member 10 is grasped with fingers through the easily-deforming portion 27, the exterior member 10 is easy to grasp with fingers and the slippage of the exterior member 10 from fingers can be suppressed in the handling thereof.

Figure 15:
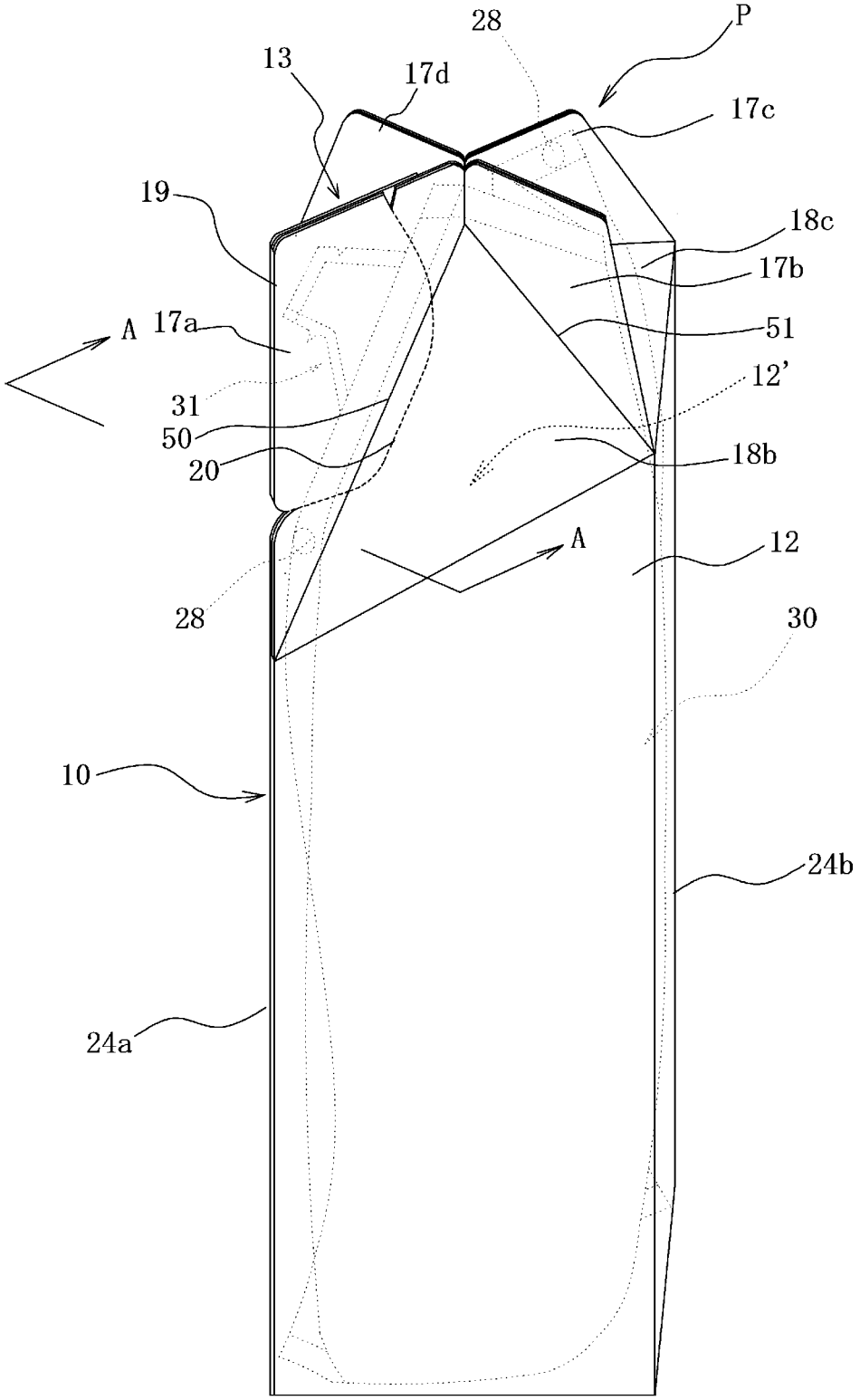
FIG. 15 is a perspective view illustrating a still further embodiment of the composite pack for filling liquid material according to the invention.

In FIG. 15 is shown a still further embodiment of the composite pack P for filling liquid material according to the invention. The exterior member 10 constituting this composite pack P for filling liquid material is provided with the cylindrical body 12 and the sealing structure unit 13 for sealing the upper end opened portion 12' of the cylindrical body 12. The sealing structure unit 13 is constructed with mountain-shaped top face walls 18*a*-18*d* and four vertical ribs 17*a*-17*d* of pairs of standing walls stood radially from the top face walls 18*a*-18*d*. The vertical rib 17*a* among these ribs acts as a cover 19 for a sheet-like nozzle 31 storing the sheet-like nozzle 31 inside in the housing of the interior member 30.

Figure 16:
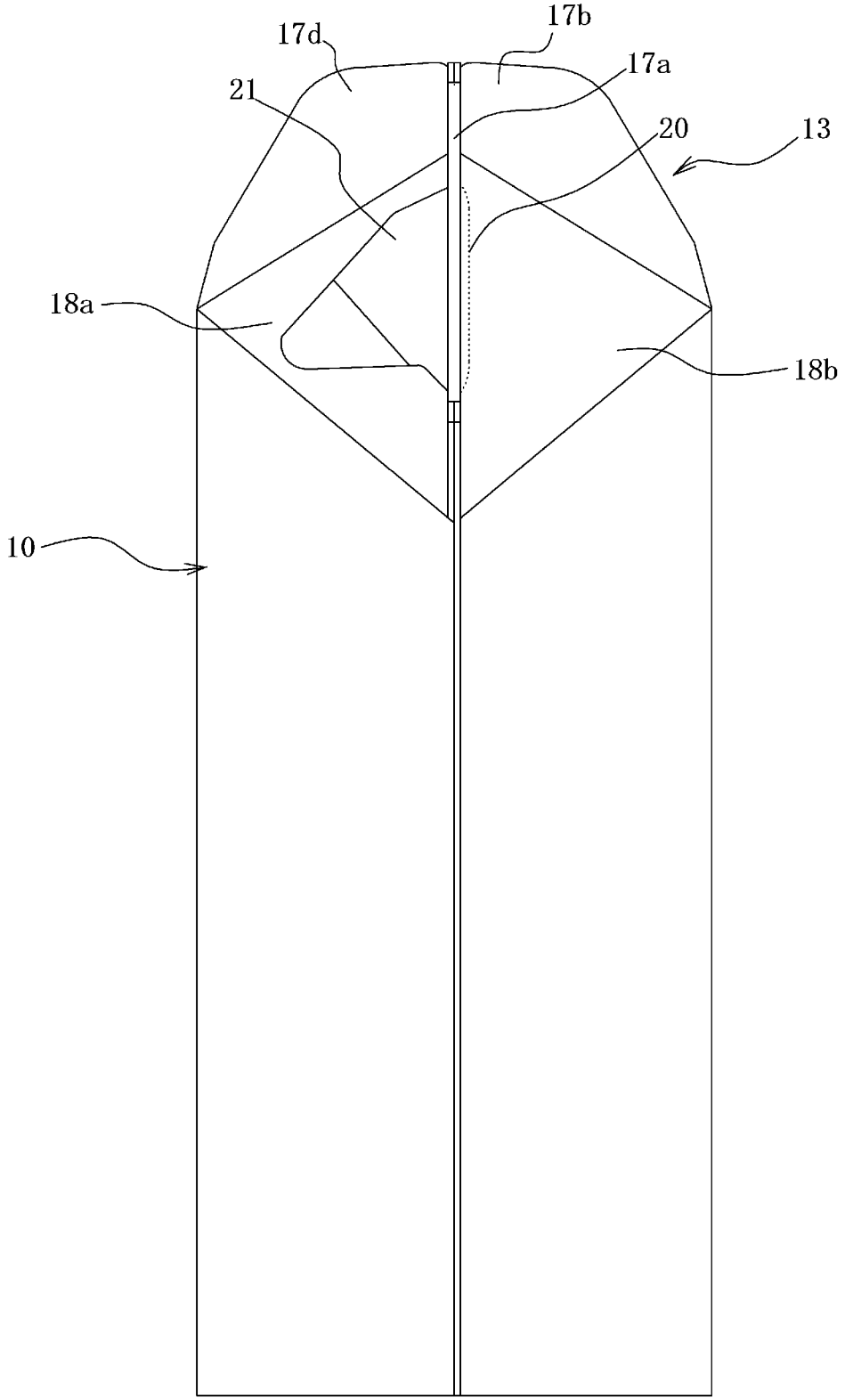
FIG. 16 is a side view of the composite pack for filling liquid material viewing from a direction of arrow A-A in FIG. 15.
Figure 17:
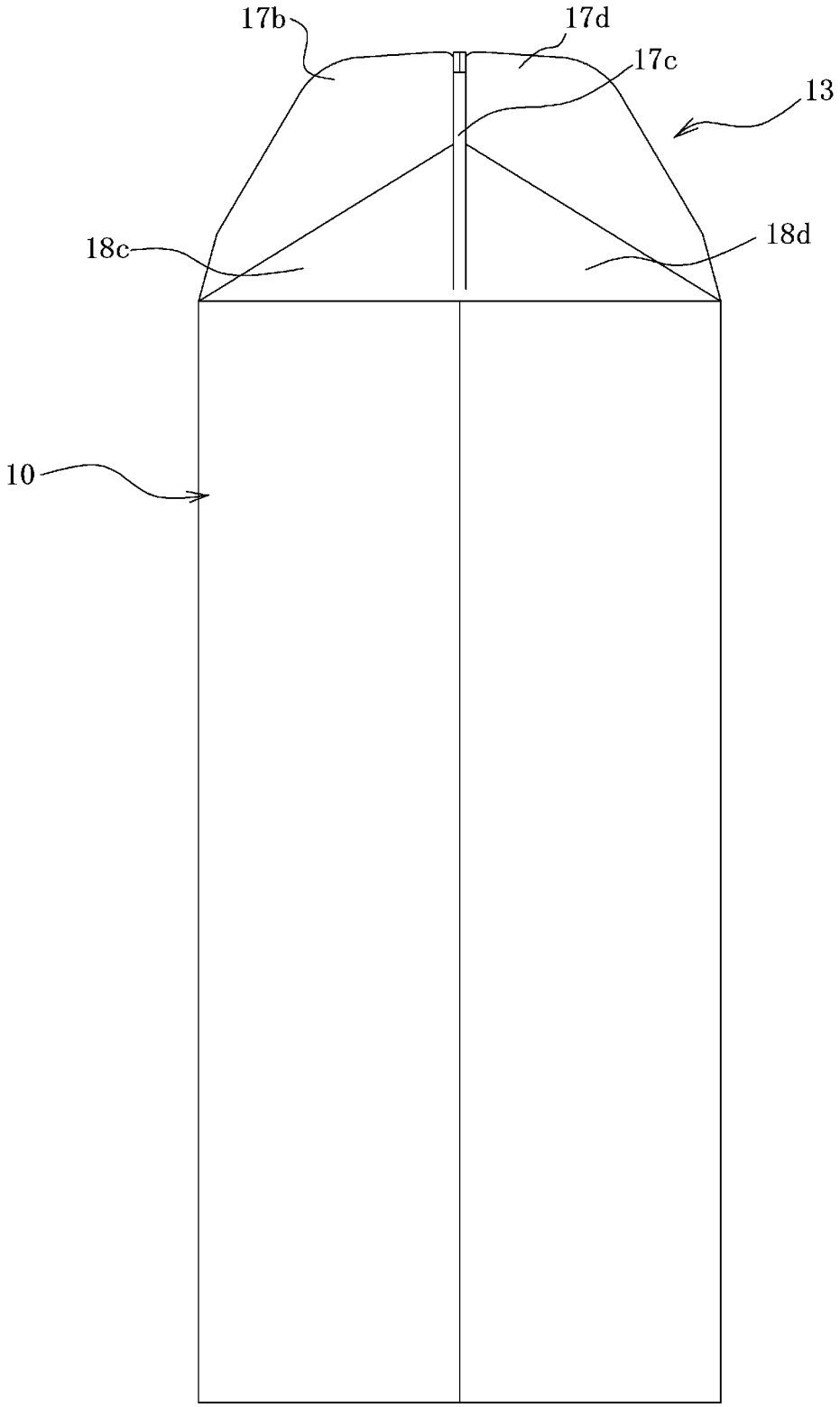
FIG. 17 is a side view of the composite pack for filling liquid material shown in FIG. 15 viewing from a side opposite to the arrow direction of FIG. 16.

FIG. 16 is a side view of the composite pack P for filling liquid material of FIG. 15 (side view at a side of vertical rib 17*a*) viewing from a direction of arrow A-A, while FIG. 17 is a side view of the composite pack P for filling liquid material viewing from a side opposite to FIG. 16 (at a side of vertical rib 17*c*). As seen from FIGS. 16 and 17, the form of the sealing structure unit 13 in the exterior member 10 is largely different between the side of vertical rib 17*a* and the side of vertical rib 17*c*.

This is due to the fact that gradients of mountain-shaped top face wall 18*a* (not shown) and 18*b* located at both sides of the vertical rib 17*a* are larger than those of the other top face walls 18*c* and 18*d* (not shown) and are steep angles. In this embodiment, a standing base end side 50 of the vertical rib 17*a* from the top face walls 18*a*, 18*b* is extended downward and positioned to a level lower than a standing base end side 51 of the other vertical ribs 17*b*-17*d*, whereby the gradients of the top face walls 18*a* and 18*b* are made large.

Since the gradients of the top face walls 18*a*, 18*b* located at both sides of the vertical rib 17*a* are made large as mentioned above, a forming space of the vertical rib 17*a* becomes large, whereby the sheet-like nozzle 31 can be housed in the inside of the vertical rib 17*a* without protruding the vertical rib 17*a* from the side wall of the cylindrical body 12. Thus, a side end edge of the vertical rib 17*a* and a side wall of the cylindrical body 12 (the predetermined crushing line 24*a* in a corner portion of the cylindrical body 12 in FIG. 15) are aligned in a straight line, whereby space saving can be attained without butting the composite packs P for filling liquid material to each other when the plural composite packs P for filling liquid material are displayed or stored side by side and a fear of breaking them can be reduced.

A length of the standing base end side 50 of the vertical rib 17*a* is 1.2-2.0 times of a length of the standing base end side 51 of the other vertical ribs 17*b*-17*d*, preferably 1.4-1.8 times thereof. When it is within the above range, the gradients of the top face walls 18*a*, 18*b* are made larger without decreasing the housing volume of the exterior member 10 to increase the forming space of the vertical rib 17*a*, whereby the whole of the sheet-like nozzle 31 can be housed in the vertical rib 17*a*. Also, when the packed liquid material is poured by cutting out the vertical rib 17*a* to expose the sheet-like nozzle 31 to external, the fixing and clamping of the sheet-like nozzle 31 with the remaining vertical rib 17*a* is made adequate, whereby the pouring amount of the packed liquid material can be controlled easily, and the pouring directionality is excellent and an effect of suppressing occurrence of liquid dripping or the like can be expected.

Figure 18:
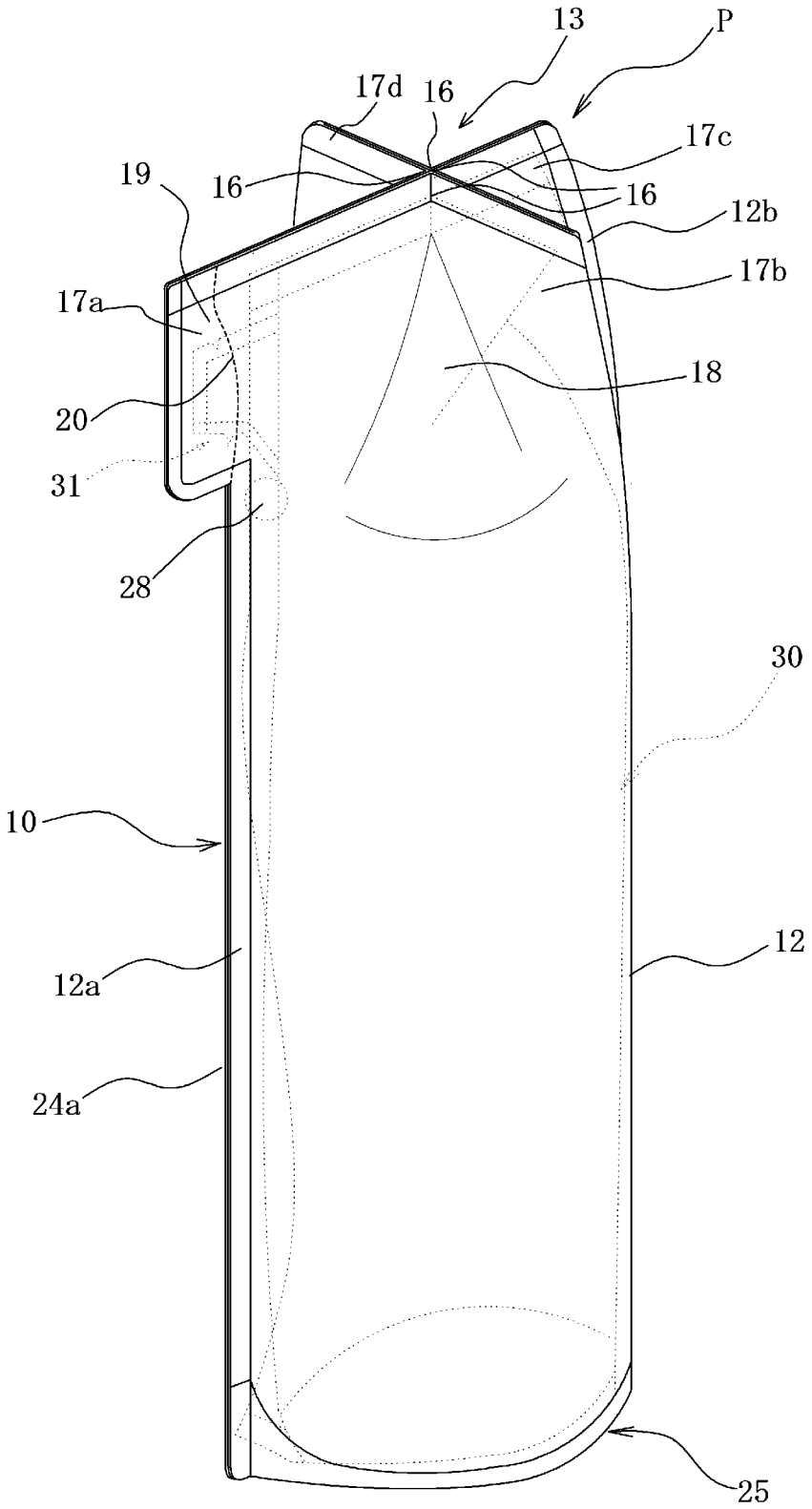
FIG. 18 is a perspective view illustrating a further embodiment of the composite pack for filling liquid material according to the invention.

In FIG. 18 is shown another embodiment of the composite pack P for filling liquid material according to the invention. In this composite pack P for filling liquid material, the exterior member 10 is made from a laminate plastic film of two or more layers composed of, for example, a base film layer and a sealant layer, and the cylindrical body 12 of a cylinder form is provided on its upper end portion with the sealing structure unit 13 constructed with four vertical ribs 17*a*-17*d* and mountain-shaped top face wall defined by these vertical ribs 17*a*-17*d*. Also, the exterior member 10 is provided on its lower end portion with a bottom wall 25 of an ellipsoid form viewing as a plan and is self-standing by the bottom wall 25.

In the laminate plastic film constituting the exterior member 10, it is preferable that the base film layer is made from polyethylene terephthalate film, nylon resin film, polypropylene or polyethylene, while the sealant layer is made from polyethylene, polypropylene or the like.

In order that the exterior member 10 has self-standing property and moldability in the housing and holding of the interior member 30, the thickness of the laminate plastic film is 80-300 μm, preferably 100-200 μm, and further a nerve of the laminate plastic film is preferably about 40-300 mN. On either surface of the base film layer may be provided a gas burrier layer such as a $SiO_2$ deposited layer, an EVOH layer, a vinylidene chloride coating layer, an aluminum oxide coating layer, an Al deposited layer or a sputtering layer thereof at a thickness of 0.5-20 μm. In this case, a steam impermeability, a gas burlier property and so on are applied to the exterior member 10, whereby it is made possible to store the liquid material housed in the interior member 30 fresh over a long period of time.

In this embodiment of the composite pack P for filling liquid material, the exterior member 10 and the interior member 30 are made from a plastic film, respectively, so that the packed liquid material can be squeezed out by folding the composite pack P for filling liquid material when the amount of the liquid material filled in the interior member 30 is decreased.

Figure 19:
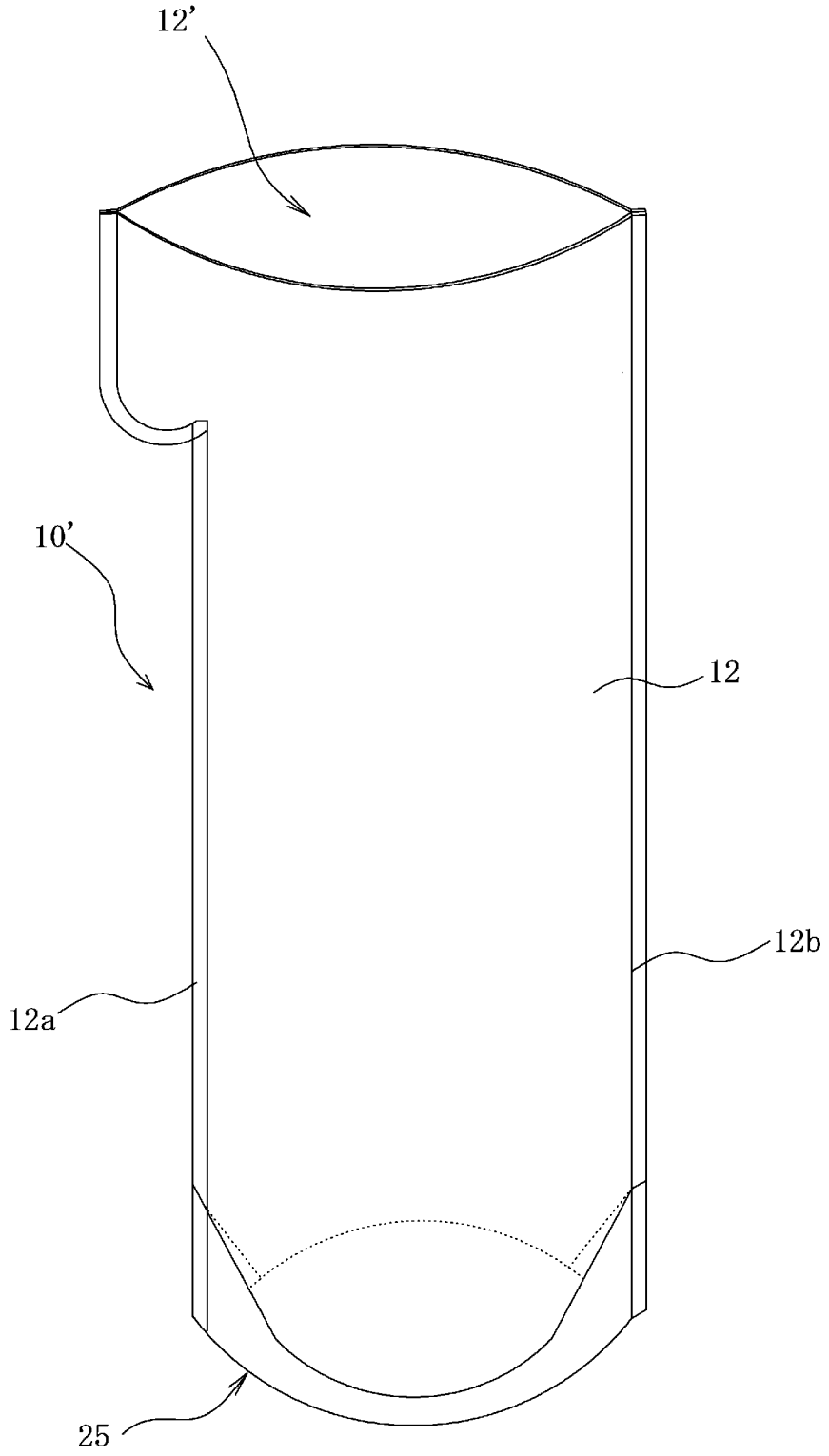
FIG. 19 is a perspective view of an exterior member constituting the composite pack for filling liquid material shown in FIG. 18 before the housing of an interior member.

FIG. 19 is a perspective view illustrating an embodiment of the exterior member 10' before the housing of the interior member 30, which is comprised of a cylindrical body 12 having a cylinder form and a self-standing bottom wall 25 disposed in a bottom thereof. Moreover, the exterior member 10' can be manufactured by various methods well-known as a method of manufacturing a standing pouch. For example, the bottom wall 25 composed of a gusset bottom can be formed by sandwiching a two-folded plastic film for bottom wall between lower ends of front and rear plastic films constituting the cylindrical body 12 so as to turn up the folded portion and sealing a peripheral portion thereof at such a state.

In FIG. 19, the cylindrical body 12 is formed by fusion-joining both side edges of the front and rear plastic films (sealing portions 12*a*, 12*b*). Also, the cylindrical body 12 may be formed by folding the single plastic film in the widthwise direction thereof.

Figure 20:
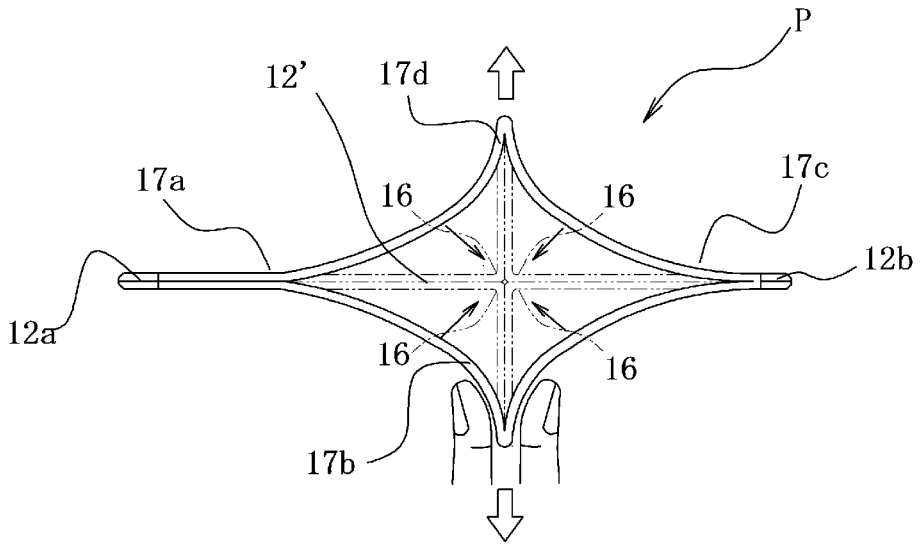
FIG. 20 is a plan view showing a method of forming a sealing structure unit in the composite pack for filling liquid material shown in FIG. 18.

After the interior member 30 is housed in the cylindrical body 12, the upper end portion of the cylindrical body 12 is folded between the sealing portion 12*a* and the sealing portion 12*b* outward so as to pick a widthwise central portion thereof as shown in FIG. 20. Thus, four internal tip portions 16 as a valley-folded portion are butted to each other to form a pair of standing walls as shown in FIG. 18, whereby a tapered sealing structure unit 13 of four vertical ribs 17*a*-17*d* arranged radially (cruciform) can be formed.

Figure 21:
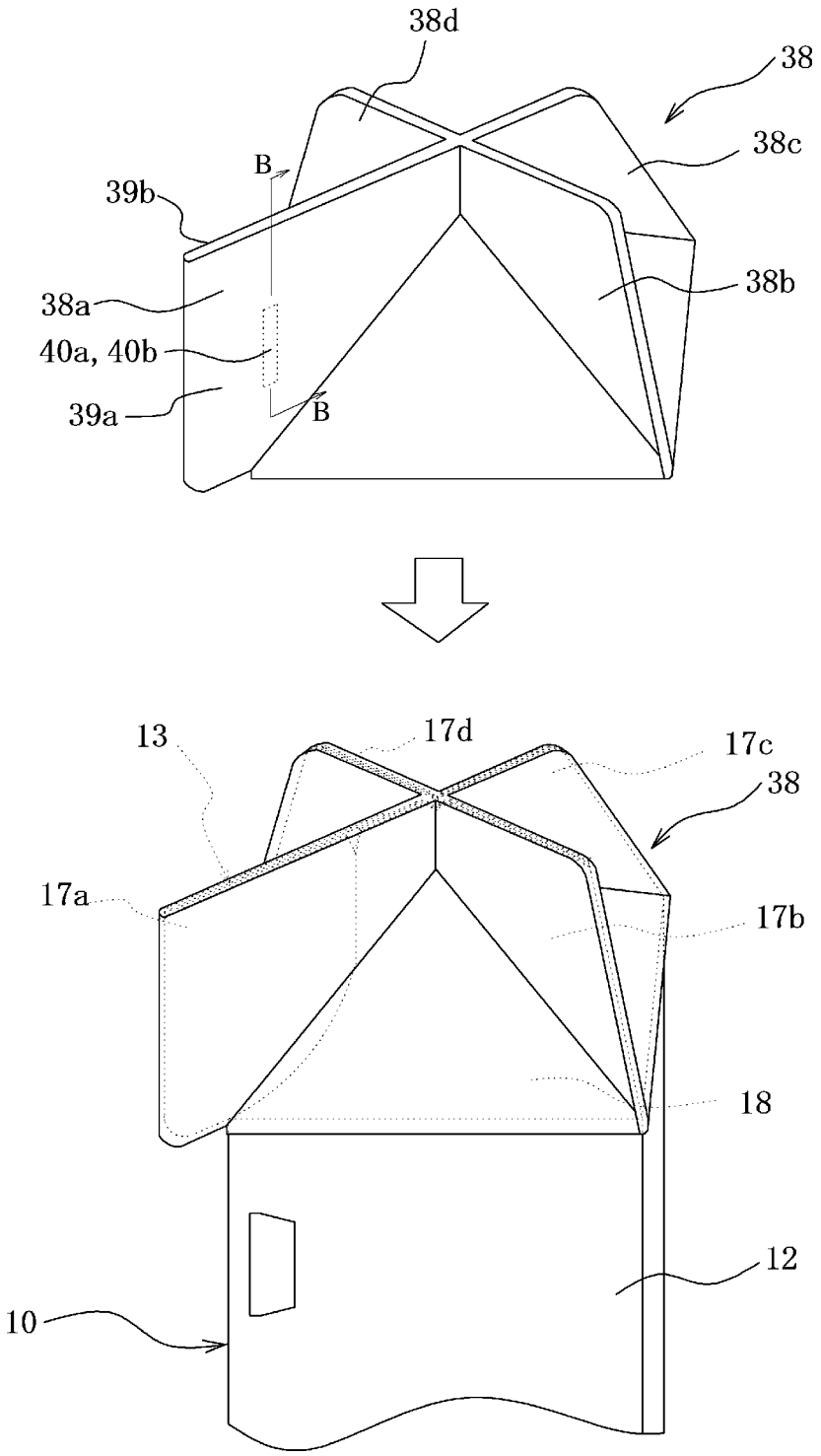
FIG. 21 is a perspective view illustrating an example of a cap disposed in a top of an exterior member of the composite pack for filling liquid material shown in FIG. 1.

In the invention, a cap 38 made from a resin, for example, a paper or the like may be disposed detachably on a head portion of the exterior member 10 in the composite pack P for filling liquid material as shown in FIG. 21. This is hygienic because the pouring port of the sheet-like nozzle 30 exposed to external can be prevented from contaminating even if the composite pack P for filling liquid material is stored over a long period of time after the opening of the sheet-like nozzle 31. Moreover, the cap 38 is preferable to be formed in approximately same form as in the sealing structure unit 13 of the exterior member 10 shown in FIG. 1 (form somewhat larger than that of the sealing structure unit 13) so as to arrange ribs 38*a*-38*d* radially (cruciform). Any form may be taken as far as at least the sheet-like nozzle 31 can be covered.

Moreover, the cap 38 is preferable to have a clamping structure that the rib 38*a* covering the vertical rib 17*a* at least clamping the sheet-like nozzle 31 can tuck at least a part of the sheet-like nozzle 31 from both side faces thereof. By such a clamping structure is suppressed a force acting to a direction of expanding the pouring pathway of the sheet-like nozzle 31 (opening direction), whereby the leakage of the liquid material can be prevented even if the composite pack P for filling liquid material is fallen down accidentally after the opening of the sheet-like nozzle 31.

Figure 23:
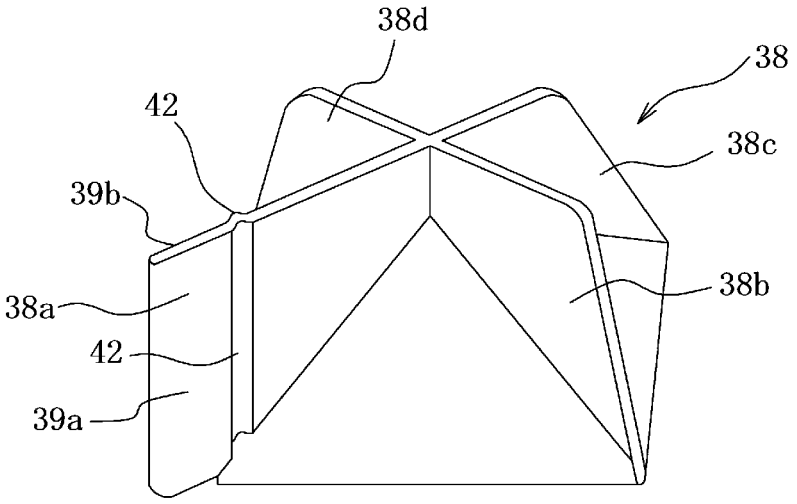
FIG. 23 is a perspective view illustrating another example of the cap disposed in the top of the exterior member of the composite pack for filling liquid material according to the invention.

As the clamping structure may be taken any structures as far as the sheet-like nozzle 31 can be clamped from both side faces thereof. For example, as shown in an end view in a position B-B of FIG. 21 (FIGS. 22(*a*),(*b*)), clamping portions 40*a*, 40*b* contacting to each other are arranged in inner faces of a pair of wall portions 39*a*, 39*b* constituting the rib 38*a* (FIG. 22(*a*)), or one or more irregularities are disposed so as to engage with inner faces of the pair of wall portions 39*a*, 39*b* (FIG. 22(*b*)), or a dogleg-shaped folding portion 42 is disposed in a longitudinal direction of the pair of wall portions 39*a*, 39*b* as shown in FIG. 23.

As shown in FIG. 22(*c*), a window hole 41 is formed in the vertical rib 17*a* and the clamping portions 40, 41 of the cap 38 are fitted into the window hole 41. Thus, the state of the cap 38 fitted into the head portion of the exterior member 10 is improved, while the detaching of the cap 38 can be prevented. By forming the window hole 41 can also be observed the sheet-like nozzle 31 located at the inside of the vertical rib 17*a* visually.

Furthermore, the cap 38 is preferable to have an engaging structure for preventing the detaching from the head portion of the exterior member 10. For example, a concave portion is formed in the lower end portion of the cap 38, while a convex portion is formed in the side face of the exterior member 10, and the cap and exterior member are rigidly fixed to each other by engaging them through the concave portion and the convex portion.

Figure 24:
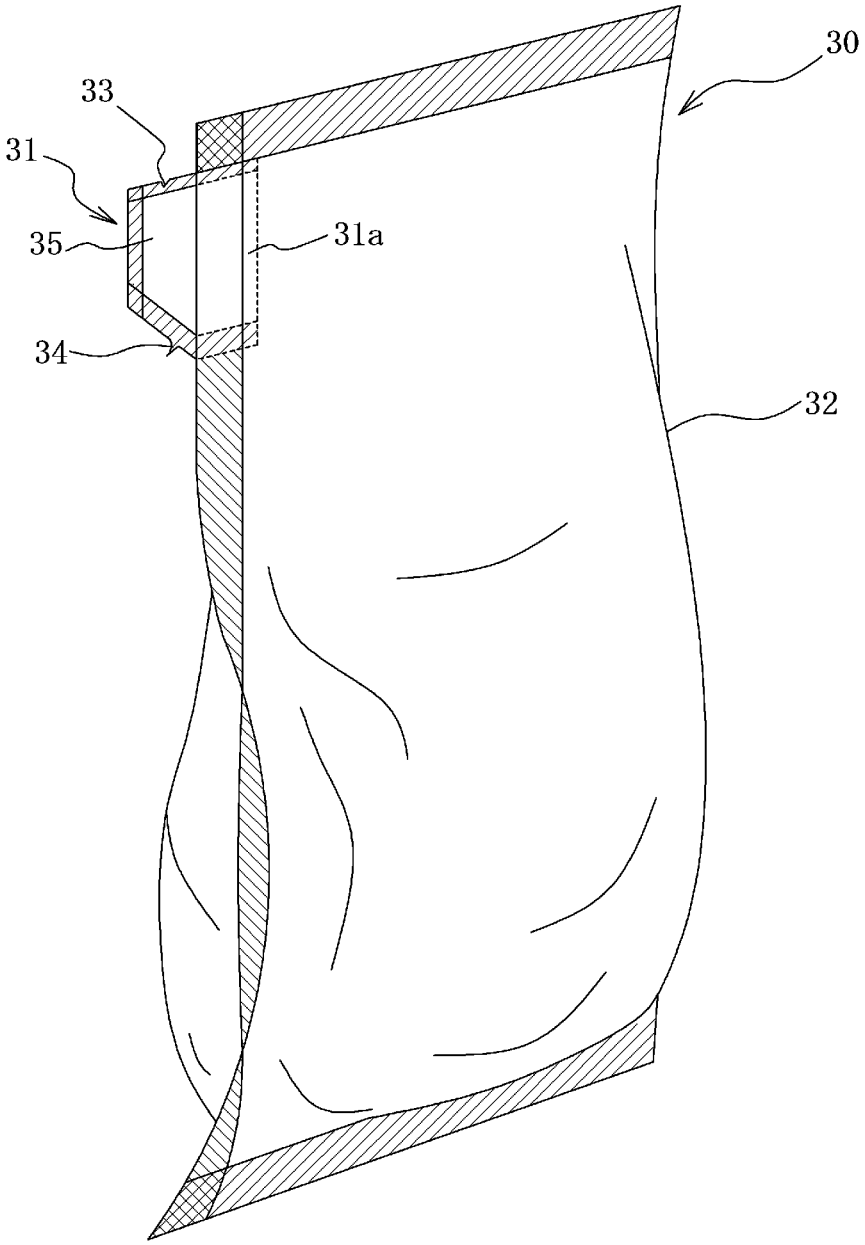
FIG. 24 is a perspective view illustrating an embodiment of an interior member constituting the composite pack for filling liquid material according to the invention.

Next, the interior member 30 will be described below. As shown in FIG. 24 as an example, the interior member 30 can be used by filling and packing a liquid or viscous material into a package bag 32 made from a laminate film, which is formed from the single plastic film or by laminating two or more plastic films or plural plastic films including a metallic foil, for example, through liquid-in seal filling. Particularly, when the package bag 32 is made from the plastic film having sufficient thickness and nerve, the occurrence of wrinkles in the package bag 32 can be suppressed to conduct smooth pouring, while the downward slippage of the interior member 30 can be suppressed when the composite pack P for filling liquid material is tilted for pouring the liquid material.

In FIG. 24, the sheet-like nozzle 31 is provided in a side and upper portion of the interior member 30 in a protruding condition. However, the sheet-like nozzle 31 may be provided in an upper end portion of the interior member 30 in a protruding condition. The sheet-like nozzle 31 can be opened, for example, by cutting out a top end portion along a notch 33 such as V-notch or the like formed near to the top end portion. Also, it is preferable that a protrusion 34 for preventing liquid from dripping and propagating is provided in a lower edge portion of the sheet-like nozzle 31 at a position near to a nozzle base end portion 31*a* in the vicinity of a predetermined opening position. Thus, the liquid dripped from the opening of the sheet-like nozzle 31 (liquid dripping) is dropped from the top of the protrusion 34 onto a floor face, whereby contamination of the interior member 30 and the exterior member 10 due to the liquid dripping can be prevented.

The sheet-like nozzle 31 is preferable to be made from a laminate plastic film comprising at least a base film layer and sealant layers laminated on both surfaces of the base film layer. The pouring pathway 35 is formed in a central portion by thermal-fusing peripheral edge portion other than the base end portion 31*a* at a state of overlapping the laminate plastic film from front and rear faces thereof.

Especially, when the sheet-like nozzle 31 has a self-sealing function, the pouring of the liquid material in the package bag 32 is performed by tilting of the package bag 32 or pushing to the package bag 32 without sucking ambient air, while when the pouring is stopped by returning the package bag 32 to the standing position or releasing the pushing of the package bag 32, the interior of the package bag 32 is rendered into a negative pressure associated with a reduced-pressure atmosphere and the inner faces of the pouring pathway 35 in the sheet-like nozzle 31 are closed to each other immediately through an intervention of a thin film of the liquid material adhered to the inner face of the pouring pathway 35 (flowed out from the inside of the package bag 32), whereby penetration of ambient air into the package bag 32 can be blocked.

INDUSTRIAL APPLICABILITY

The composite pack for filling liquid material according to the invention can be utilized as a vessel for filling and packing a liquid or viscous material such as beverages, medicines, chemicals or the like.

DESCRIPTION OF REFERENCE SYMBOLS

P composite pack for filling liquid material
10, 10' exterior member
11 circular body
12 cylindrical body

12' upper end opened portion
13 sealing structure unit
14 mountain-folded line
15 valley-folded line
16 internal tip portion
17*a*, 17*b*, 17*c*, 17*d* vertical rib
18 top face wall
19 cover
20 predetermined cut-off line
21 flap
22 connecting piece
23 notch portion
24*a*, 24*b* predetermined crushing line
25 bottom wall
26 predetermined bending line
27 easily-deforming portion
28 fixed portion
29 concave strip
30 interior member
31 sheet-like nozzle
31*a* base end portion
32 package bag
33 V notch
34 protrusion
35 pouring pathway
37 incision
38 cap
38*a*, 38*b*, 38*c*, 38*d* rib
39*a*, 39*b* wall portion
40*a*, 40*b* clamping portion
41 window hole
42 folding portion
50, 51 standing base end side
52 border line

The invention claimed is:

1. A composite pack for filling a liquid material, comprising:

a bag-shaped interior member including a soft package bag filled with a liquid material; and an exterior member having a cylindrical body provided on a lower end with a bottom wall and on an upper end with an opening for housing the interior member, wherein the interior member is provided with a sheet-like pouring nozzle for liquid material, the sheet-like pouring nozzle protruding from an upper end portion or a side end upper portion of the package bag, and the exterior member includes a top face wall for closing the opening and plural vertical ribs standing up from the top face wall, one of the plural vertical ribs is a vertical cover rib for clamping and covering the sheet-like pouring nozzle for liquid material, and the vertical cover rib includes a given cut-off line capable of exposing the sheet-like pouring nozzle.

2. The composite pack for filling a liquid material according to claim 1, wherein the plural vertical ribs comprise at least three vertical ribs standing up from the flat or mountain-type top face wall and the at least three vertical ribs are arranged radially from an approximately central position of the cylindrical body in a planar view of the cylindrical body.

3. The composite pack for filling a liquid material according to claim 1, wherein each vertical rib of the plural vertical ribs is provided by overlapping a pair of standing walls provided by cutting and raising a part of the top face wall.

4. The composite pack for filling a liquid material according to claim 3, wherein the vertical rib is provided by connecting one standing wall to the other standing wall through a connecting piece.

5. The composite pack for filling a liquid material according to claim 4, wherein the connecting piece is provided with a notch as a starting point for breaking the connecting piece by applying an external force to each standing wall constituting the vertical rib so as to separate from each other.

6. The composite pack for filling a liquid material according to claim 1, wherein faces of the top face wall located at both sides of the vertical cover rib have a gradient larger than a gradient of the other faces of the top face wall.

7. The composite pack for filling a liquid material according to claim 6, wherein a lower end of the vertical cover rib is positioned lower than a lower end of an other vertical rib.

8. The composite pack for filling a liquid material according to claim 1, wherein the interior member includes a protruding end of the sheet-like pouring nozzle for the liquid material, and the protruding end is located on an inner side of a side wall of the cylindrical body of the exterior member.

9. The composite pack for filling a liquid material according to claim 1, wherein the package bag comprises a single plastic film or a laminate film provided by laminating one or more plastic films or plural plastic films including a metallic foil, and the exterior member comprises a paper, a plastic film or a composite of plastic film and paper.

10. The composite pack for filling a liquid material according to claim 1, wherein at least one portion of an upper end portion of the interior member is joined and fixed to the exterior member.

11. The composite pack for filling a liquid material according to claim 1, wherein the cylindrical body of the exterior member has an approximately equal opening area over a full length from the bottom wall to the opening on the upper end of the exterior member.

12. The composite pack for filling a liquid material according to claim 1, wherein the exterior member is provided with a detachable cap for covering the sheet-like pouring nozzle for the liquid material during exposure.

13. The composite pack for filling a liquid material according to claim 1, wherein the sheet-like pouring nozzle for the liquid material has a self-sealing function that pouring of the liquid material in the package bag is performed by tilting the package bag or pushing the package bag without sucking external air, and an inner face of a pouring pathway in the sheet-like pouring nozzle for the liquid material is closed immediately with a thin film of the liquid material flowed from the package bag to block penetration of external air into the package bag in stopping the pouring by returning the package bag to a stand posture or releasing the pushing of the package bag.

* * * * *